US008961705B2

(12) United States Patent
Jerg et al.

(10) Patent No.: US 8,961,705 B2
(45) Date of Patent: Feb. 24, 2015

(54) DISHWASHER MACHINE COMPRISING A SORPTION DRYING SYSTEM

(75) Inventors: Helmut Jerg, Giengen (DE); Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1042 days.

(21) Appl. No.: 13/056,131

(22) PCT Filed: Jul. 28, 2009

(86) PCT No.: PCT/EP2009/059699

§ 371 (c)(1),
(2), (4) Date: Jan. 27, 2011

(87) PCT Pub. No.: WO2010/012703

PCT Pub. Date: Feb. 4, 2010

(65) Prior Publication Data

US 2011/0126867 A1 Jun. 2, 2011

(30) Foreign Application Priority Data

| | | |
|---|---|---|
| Jul. 28, 2008 | (DE) | 10 2008 040 789 |
| Aug. 27, 2008 | (DE) | 10 2008 039 900 |
| Nov. 7, 2008 | (DE) | 10 2008 043 581 |

(51) Int. Cl.

| | |
|---|---|
| ***B08B 3/00*** | (2006.01) |
| ***A47L 15/48*** | (2006.01) |
| ***A47L 15/00*** | (2006.01) |

(52) U.S. Cl.

CPC ..... *A47L 15/481* (2013.01); *A47L 15/0026* (2013.01); *A47L 15/0034* (2013.01); *A47L 2301/00* (2013.01); *A47L 2501/04* (2013.01); *A47L 2501/06* (2013.01); *A47L 2501/07* (2013.01); *A47L 2501/30* (2013.01)

USPC ..... 134/56 D; 134/57 D

(58) Field of Classification Search

None

See application file for complete search history.

(56) References Cited

U.S. PATENT DOCUMENTS

| | | | |
|---|---|---|---|
| 4,971,611 | A | 11/1990 | Noguchi |
| 5,341,848 | A | 8/1994 | Laws |
| 5,364,455 | A | 11/1994 | Komarneni et al. |

(Continued)

FOREIGN PATENT DOCUMENTS

| | | | |
|---|---|---|---|
| CN | 201012079 | Y | 1/2008 |
| DE | 1180355 | B | 10/1964 |

(Continued)

OTHER PUBLICATIONS

National Search Report CN 200980129490.2.

(Continued)

*Primary Examiner* — Jason Ko

(74) *Attorney, Agent, or Firm* — James E. Howard; Andre Pallapies

(57) ABSTRACT

A dishwasher has a washing compartment; an air-guiding channel; and a sorption drying system to dry items to be washed. The sorption drying system includes a sorption compartment with reversibly dehydratable sorption drying material. The sorption compartment is connected to the washing compartment by the air-guiding channel for passage of an air flow. The sorption compartment has a sorption unit with the sorption drying material. The geometric shape of the sorption compartment is such that the sorption unit is provided with a default through-flow direction for the air flow substantially in or against the direction of gravity.

61 Claims, 12 Drawing Sheets

(56) References Cited

U.S. PATENT DOCUMENTS

| | | | | |
|---|---|---|---|---|
| 5,529,093 | A | 6/1996 | Gallagher et al. | |
| 5,566,880 | A | 10/1996 | Khelifa et al. | |
| 5,879,764 | A * | 3/1999 | Chu et al. | 428/34 |
| 6,434,857 | B1 | 8/2002 | Anderson et al. | |
| 7,585,373 | B2 | 9/2009 | Jerg et al. | |
| 8,123,869 | B2 | 2/2012 | Jerg et al. | |
| 8,459,278 | B2 | 6/2013 | Jerg et al. | |
| 2003/0000106 | A1 | 1/2003 | Anderson et al. | |
| 2003/0153457 | A1 | 8/2003 | Nemoto et al. | |
| 2004/0169449 | A1 * | 9/2004 | Kim | 312/228 |
| 2006/0278257 | A1 | 12/2006 | Jerg et al. | |
| 2007/0101609 | A1 | 5/2007 | Jerg et al. | |
| 2007/0234588 | A1 | 10/2007 | Classen et al. | |
| 2007/0245899 | A1 | 10/2007 | Merdzo | |
| 2007/0295360 | A1 | 12/2007 | Jerg et al. | |
| 2007/0295373 | A1 | 12/2007 | Jerg et al. | |
| 2008/0083433 | A1 | 4/2008 | Jerg et al. | |
| 2008/0127997 | A1 | 6/2008 | Jerg et al. | |
| 2008/0149142 | A1 | 6/2008 | Jerg et al. | |
| 2010/0326480 | A1 | 12/2010 | Jerg et al. | |
| 2011/0132412 | A1 | 6/2011 | Jerg et al. | |
| 2011/0139193 | A1 | 6/2011 | Jerg et al. | |
| 2011/0139195 | A1 | 6/2011 | Jerg et al. | |
| 2011/0139198 | A1 | 6/2011 | Jerg et al. | |
| 2012/0234354 | A1 | 9/2012 | Jerg et al. | |

FOREIGN PATENT DOCUMENTS

| | | | |
|---|---|---|---|
| DE | 1567507 | A1 | 4/1970 |
| DE | 3741652 | A1 | 6/1986 |
| DE | 3626887 | A1 | 2/1988 |
| DE | 3926597 | A1 | 2/1991 |
| DE | 4304076 | A1 | 8/1994 |
| DE | 4405202 | A1 | 9/1994 |
| DE | 4441264 | A1 | 5/1996 |
| DE | 68928556 | T2 | 4/1998 |
| DE | 19917740 | A1 | 10/2000 |
| DE | 10353774 | A1 | 2/2005 |
| DE | 10353775 | A1 | 2/2005 |
| DE | 102005004094 | A1 | 6/2006 |
| DE | 102005004095 | A1 | 6/2006 |
| DE | 102005004096 | A1 | 6/2006 |
| EP | 0358279 | A1 | 3/1990 |
| EP | 0777998 | A1 | 2/1997 |
| EP | 1097669 | A2 | 5/2001 |
| EP | 1674029 | A1 | 6/2006 |
| EP | 1674030 | A1 | 6/2006 |
| FR | 1169658 | A1 | 1/1959 |
| FR | 2648484 | A1 | 12/1990 |
| FR | 2649001 | B1 | 10/1991 |
| GB | 2142128 | A | 1/1985 |
| JP | 5161591 | A1 | 6/1993 |
| JP | 2005034523 | A | 2/2005 |
| WO | 0203002 | A1 | 1/2002 |
| WO | 2005053502 | A1 | 6/2005 |
| WO | 2005094660 | A1 | 10/2005 |
| WO | 2006061293 | A | 6/2006 |

OTHER PUBLICATIONS

Report of Examination CN 200980129490.2.

Perry and Green, Perry's Chemical Engineers' Handbook, Sixth Edition, Published 1984.

Grace GmbH Brochure, "Molecular Sieves—Characteristics and Applications," 1979.

Rhone-Poulenc Specialities Chimiques Technical Documentation Regarding Molecular sieve 4A, "Molecular sieve 3A," Molecular sieve 5A, and "Molecular sieve 13X," 1982.

Hauer, "Evaluation of Solid Adsorbents in Open Sorption Systems for Energetic Applications," Dissertation TU Berlin, 2002.

Haefner et al., "Transient Sorption of Water Vapour from Air Flowing Through Beds of Zeolite 13X," Ind. Eng. Chem. Fundam., 1986, 25, 498-503.

Opposition and English Translation against European Patent No. EP 2 317 904 B1, issued by European Patent Office, dated Nov. 6, 2012, 27 pages.

Union Carbide brochure, "Molecular Sieves," 1979.

Report of Examination including National Search Report CN 200980133457.7.

Report of Examination including National Search Report CN 200980133141.8 dated Dec. 28, 2012.

Report of Examination including National Search Report CN 200980133458.1.

* cited by examiner

DISHWASHER MACHINE COMPRISING A SORPTION DRYING SYSTEM

BACKGROUND OF THE INVENTION

The present invention relates to a dishwasher machine, in particular a household dishwasher machine, comprising at least one washing compartment and at least one sorption drying system for drying items to be washed, the sorption drying system having at least one sorption compartment (SB) comprising a reversibly dehydratable sorption drying material, said compartment being connected to the washing compartment by means of at least one air-guiding channel for the passage of an air flow.

For example, from DE 103 53 774 A1, DE 103 53 775 A1 or DE 10 2005 004 096 A1, dishwasher machines with a so-called sorption column for drying dishes are known. In the "drying" subprogram step of the respective dishwashing program of the dishwasher machine for drying dishes, moist air is guided by means of a fan out of the washing compartment of the dishwasher machine through the sorption column and moisture is removed from the air guided therethrough by the reversibly dehydratable sorption drying material of said sorption column. For regeneration, i.e. desorption of the sorption column, the reversibly dehydratable sorption drying material thereof is heated to very high temperatures. Water stored in this material is thereby released as hot steam and is guided by an air flow generated by means of the fan into the washing compartment. Wash liquor, items to be washed located in the washing compartment, such as e.g. dishes and/or the air located in the washing compartment can be heated by this means. A sorption column of this kind has proven to be highly advantageous for the energy-saving and quiet drying of dishes. To prevent local overheating of the sorption drying material during the desorption process, in DE 10 2005 004 096 A1, for example, a heater is arranged, in the direction of flow of the air, upstream of the air inlet of the sorption column. Despite this "air heating" during desorption, it remains difficult in practice to dry the reversibly dehydratable drying material consistently adequately and thoroughly.

BRIEF SUMMARY OF THE INVENTION

The object of the invention is to provide a dishwasher machine, in particular a household dishwasher machine, which enables in a simple and reliable manner improved sorption and/or desorption with respect to the reversibly dehydratable sorption drying material in the sorption compartment of its sorption drying device.

This object is achieved in a dishwasher machine, in particular a household dishwasher machine, of the type specified in the introduction, in that the sorption compartment is embodied with a geometric shape such that for its sorption unit comprising the sorption drying material a default through-flow direction for the air flow is made substantially in or against the direction of gravity.

This ensures to a large extent that moist air which in the respectively required drying process is guided by means of the air-guiding channel out of the washing compartment into the sorption compartment and flows through the sorption unit thereof comprising the sorption drying material can be dried in a thorough, reliable and energy-efficient manner through sorption by means of the sorption drying material. Later after this drying process, e.g. in at least one rinsing or cleaning cycle of a later newly started dishwashing program, the sorption material can be regenerated through desorption, i.e. treated, again in a thorough, energy-efficient and material-saving manner in preparation for a subsequent drying process.

In particular, the sorption compartment can because of its specific through-flow characteristics be embodied in a particularly compact and space-saving manner, yet nonetheless accommodate in the sorption compartment the quantity of sorption drying material required for thorough sorption and desorption.

This geometric shape of the sorption compartment also makes it possible, in particular, for the original or initial sorption and/or desorption behavior of the sorption unit to be retained to a large extent even when during the service life of the dishwasher machine the fill volume of the sorption drying material in the sorption unit compacts, i.e. settles, due to its own weight and thereby loses height. The advantageous predetermination of the through-flow direction of air through the sorption compartment substantially in or against the direction of gravity, in particular in a vertical direction relative to a substantially horizontal penetration area of the sorption unit means that any such material settlement of the sorption drying material interferes little, if at all, with respect to the functional capacity, i.e. in particular the moisture, preferably water, absorption capacity and moisture, preferably water, release capacity of the sorption unit. The functional capacity of the sorption drying system thus continues to be ensured even then, since the design according to the invention preferably ensures, relative to a substantially horizontal penetration area of the sorption unit, at every point approximately the same fill conditions, in particular deposition conditions, and thus approximately the same through-flow conditions and related flow-resistance conditions over the product service life of the dishwasher machine, which permits optimum utilization of the sorption and/or desorption capacity of the sorption material while simultaneously keeping the quantity of material small. Furthermore, inadmissible displacements of material, which could lead to local accumulations of material or local reductions of material and related interference with, overloading of or even damage to the sorption drying material during the respective sorption process or desorption process, can to a large extent be avoided by the inventive geometric shape of the sorption compartment. Unlike a sorption compartment which predetermines a substantially horizontally-oriented positioning of the sorption unit and horizontal through-flow of air therethrough, in the inventive geometric shape of the sorption compartment, the sorption unit thereof predetermines for, in particular forces upon, the through-flowing air an air pathway with a through-flow direction substantially in or against the direction of gravity, i.e. in particular in a vertical direction.

According to a useful development of the invention, the sorption unit can be arranged in the sorption compartment such that air from the washing compartment can flow through the total volume, in particular fill volume, of its sorption drying material substantially in a vertical through-flow direction against the direction of gravity. In this way, the originally predetermined layering, in particular fill conditions of the sorption drying material are substantially retained during the service life of the dishwasher machine at all points of the intake cross-sectional area of the sorption unit even after any settling of the material.

In particular, the volume of the sorption drying material at every point downstream of the inlet cross-sectional area of the sorption unit can advantageously exhibit the same layer height, even if settling of material occurs over time. This constantly ensures largely homogeneous and uniform through-flow conditions relative to the respective through-flow cross-sectional area of the sorption unit, which favors and facilitates sorption and desorption respectively.

If according to an advantageous development of the invention, in particular, the positioning of the sorption unit in the sorption compartment is such that a substantially vertical through-flow direction is impressed upon it, this largely prevents a bypass channel from forming in the sorption unit as a result of sorption drying material deposits, in which bypass channel little or no sorption drying material is present. Such an undesired uneven distribution of sorption drying material, viewed over the through-flow cross-section of the sorption unit could indeed impair e.g. its sorption efficiency, desorption efficiency and material ageing.

The sorption compartment can, in particular, be embodied and arranged as a through-flow channel such that a substantially vertical through-flow direction is predetermined for its through-flow area. It can advantageously form for the through-flowing air, in particular, a chimney-type drying device with a vertical main direction of through-movement during the respective sorption process or a chimney-type heating device with a vertical main direction of through-movement during the respective desorption process.

The sorption compartment can usefully be embodied with a substantially pot-type, tubular, sleeve-type or cylindrical shape. These geometric shapes are compact and simplify accommodation of the sorption unit and optionally of one or more further components such as e.g. a heater device or flow-conditioning elements. The sorption unit can, viewed in the height direction, have around the intermediate space between its lower intake cross-sectional area and its upper discharge cross-sectional area arranged at a predefined height interval therefrom one or more side walls or casings which run partially or fully in particular in a substantially vertical positional plane. The respective casing around the outer periphery of the sorption unit can be composed in particular also solely of one or more wall parts of the inner housing of the sorption compartment which encloses the sorption unit. This advantageously gives the sorption drying material of the sorption unit an outer shell which extends in a height direction between its lower air-intake cross-sectional area and its upper air-discharge cross-sectional area, which is arranged at a predefinable height interval therefrom.

Furthermore, the sorption compartment can advantageously comprise a substantially horizontally arranged base part and a substantially horizontally arranged cover part. In this way, the various elements and components of the sorption compartment can be assembled in a simple manner. In particular, it can be useful if the sorption unit and/or, optionally, a heating device arranged upstream of it in the sorption compartment form a sorption column which is largely vertically-oriented or set on end. To accommodate such a sorption column, in particular, a substantially vertically-oriented sleeve-type or cylindrical sorption compartment can be useful.

According to a further useful development, the sorption drying material largely completely fills in the sorption unit of the sorption compartment, in particular, a fill volume which lies between the substantially horizontally arranged flow-intake cross-sectional area and the flow-discharge cross-sectional area arranged largely parallel thereto. In the interior of the housing jacket of the sorption compartment, for this purpose in particular at least one substantially horizontally arranged lower air-permeable base element is provided as an integral component of the sorption unit, on which base element the sorption drying material thereof is supported. The housing of the sorption compartment advantageously forms at the same time a peripheral side casing around the air-permeable base element such that the sorption drying material on the air-permeable base element is laterally enclosed and held with a desired layer or fill height. The sorption unit can optionally additionally have its own side casing or shell, i.e. expressed in generalized terms, one or more housing side walls, around its outer periphery. In the interior of the housing jacket of the sorption compartment, at least one substantially horizontally arranged upper air-permeable cover element can optionally usefully be provided at a desired layer height from the lower air-permeable base element as an integral part of the sorption unit. In this way, the sorption material in the sorption unit is to a large extent reliably secured in position between the lower base element and the upper cover element.

The sorption unit of the sorption compartment can in particular comprise at least one lower, substantially horizontally arranged, sieve element or grid element as an air-permeable base element and at least one upper, substantially horizontally arranged, sieve element or grid element as an air-permeable cover element at a predefined height interval from one another. The spatial volume between these two substantially horizontally arranged sieve elements or grid elements and the lateral housing jacket of the sorption compartment is usefully to a large extent completely filled with sorption drying material. This allows in a defined manner a desired layering and distribution of the sorption drying material to be maintained over the entire service life of the dishwasher machine. In particular, this ensures that at all air-inlet points of the intake cross-sectional area of the sorption unit the sorption drying material can be supported on the lower air-permeable base element with approximately the same, i.e. constant layer or fill thickness. This advantageously enables a largely homogeneous, even flow-resistance to be established at each point of the intake cross-sectional area of the sorption unit. In particular, a sorption unit or sorption column is thereby formed which, while dimensionally compact, enables in an energy-efficient manner the thorough absorption of a defined quantity of water from air to be dehumidified during the respective sorption process and at the same time the thorough and complete release of this stored water during the next desorption process. Moreover, by means of this advantageous positioning of the sorption drying material of the sorption unit, in which air flows through the sorption unit in particular against the direction of gravity, the volume of sorption drying material which is flowed through in each case remains largely the same for all inlet points of the air-intake cross-sectional area of the sorption unit even if the sorption drying material were to settle toward the bottom in the course of the product service life of the dishwasher machine and its layer or bed height decrease, if in relation to all the inlet points of the air-intake cross-sectional area of the sorption unit a constant layer height of sorption material volume had been predefined as the starting condition. The through-flow characteristics and the flow-resistance characteristics then remain substantially uniform for the sorption material volumes of all inlet points downstream of the air-intake cross-sectional area of the sorption unit. The formation of an unwanted bypass channel with insufficient or no sorption drying material inside the sorption unit, as well as local sorption material accumulations, are thus largely avoided. In this way, all the sorption drying material in the sorption compartment can constantly be used in an energy-efficient manner for sorption and desorption in each case. Since then even a relatively small quantity of sorption drying material can advantageously suffice for achieving a desired sorption and desorption effect, the housing dimensions of the sorption compartment can also be kept sufficiently compact as to enable a space-saving installation of the sorption compartment, in particular into the base module below the base of the dishwasher machine.

Other developments of the invention are described in the subclaims.

BRIEF DESCRIPTION OF THE DRAWINGS

The invention and its developments as well as the advantages thereof are explained in detail below with the aid of drawings, in which.

DETAILED DESCRIPTION OF EXEMPLARY EMBODIMENTS OF THE PRESENT INVENTION

Figure 1:
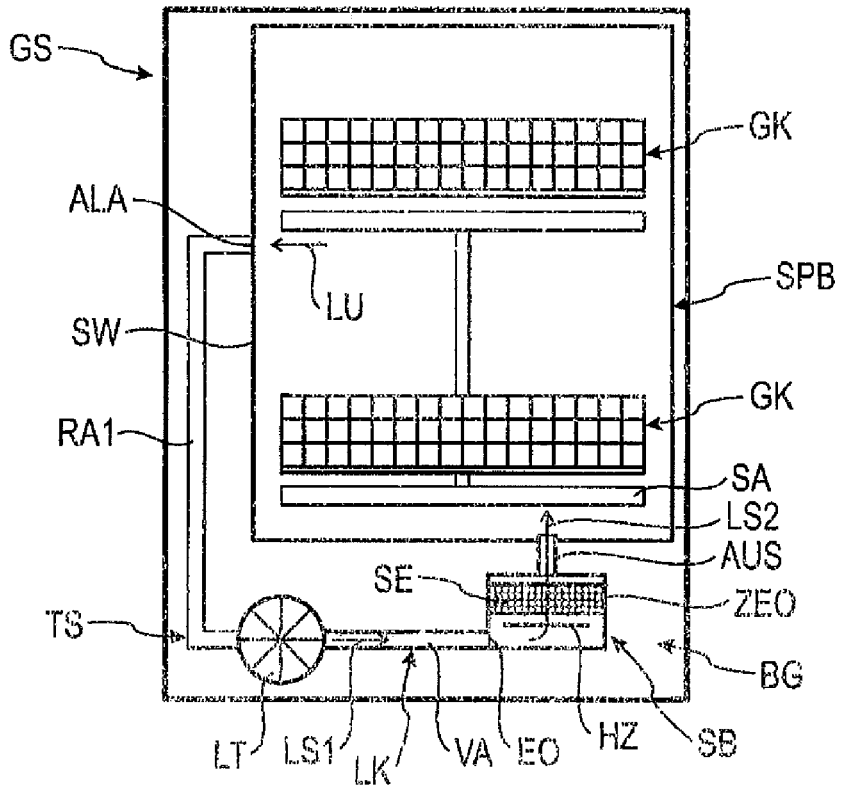
FIG. 1 shows schematically a dishwasher machine comprising a washing compartment and a sorption drying system, the components of which are embodied according to the inventive design principle.

Elements having an identical function and mode of operation are in each case labeled with the same reference characters in FIGS. 1 to 17.

FIG. 1 shows in schematic representation a dishwasher GS which comprises as its main components a washing container SPB, a base module BG arranged thereunder and a sorption drying system TS according to the inventive design principle. The sorption drying system TS is preferably provided externally, i.e. outside the washing compartment SPB, partially on a side wall SW and partially in the base module BG. It comprises as main components at least one air-guiding channel LK, at least one fan unit or a blower LT inserted in said air-guiding channel LK and at least one sorption compartment SB. The washing compartment SPB preferably accommodates one or more mesh baskets GK for receiving and for washing items to be washed such as e.g. dishes. One or more spray devices such as e.g. one or more rotating spray arms SA are provided in the interior of the washing compartment SPB for spraying the items to be cleaned with wash liquor. In the exemplary embodiment here, both a lower spray arm and an upper spray arm are rotatingly suspended to allow them to rotate in the washing container SPB.

To clean items to be washed, dishwasher machines run through wash programs which comprise a plurality of program steps. The respective wash program may comprise in particular the following individual program steps which run consecutively: at least one prewash step with the addition of liquid, in particular water, for removing coarse soiling; at least one cleaning step with the addition of detergent to liquid, in particular water; at least one intermediate rinse step; at least one final rinse step with the application of liquid such as e.g. water mixed with wetting agents, in particular rinse aid, and at least one final drying step in which the cleaned items are dried. Depending on the cleaning step or wash cycle of a selected dishwashing program, the items to be washed in each case have e.g. fresh water and/or clean used water mixed with detergent applied as wash liquor for the respective prewash cycle and/or intermediate rinse cycle, fresh water and/or used water mixed with at least one detergent e.g. for the respective cleaning cycle or for the respective intermediate rinse cycle, and/or fresh water and/or preferably clean used water mixed with rinse aid for a final rinse cycle.

The fan unit LT and the sorption compartment SB are accommodated in the exemplary embodiment here in the base module BG underneath the base BO of the washing compartment SPB. The air-guiding channel LK runs from an outlet opening ALA which is provided above the base BO of the washing compartment SPB in a side wall SW thereof, externally on this side wall SW with an inlet-end tube portion RA1 down to the fan unit LT in the base module BG. The outlet of the fan unit LT is connected by means of a connecting section VA of the air-guiding channel LK to an intake opening EO of the sorption compartment SB, here preferably in a region thereof close to the base. The outlet opening ALA of the washing compartment SPB is provided in the exemplary embodiment here above the base BO thereof, preferably in the middle region or in the central region of the side wall SW, for sucking air out of the interior of the washing compartment SPB. Alternatively, it is of course also possible to fit the outlet opening in the back wall RW (see FIG. 2) of the washing compartment SPB. Viewed more generally, it may in particular be advantageous to provide the outlet opening preferably at least above a foam level up to which foam may form e.g. in a cleaning cycle or wash cycle, preferably in the upper half of the washing compartment in one of the side walls and/or back wall thereof. The outlet opening can optionally also be provided in the top wall of the washing compartment. It can optionally also be useful to introduce multiple outlet openings in at least one side wall, top wall and/or the back wall of the washing compartment SPB and to connect these outlet openings by means of at least one air-guiding channel to one or more inlet openings in the housing of the sorption compartment SB before the beginning or start of the sorption drying material portion thereof. It can optionally be useful to provide multiple air-guiding channels simultaneously, i.e. in parallel next to one another, between the one or more outlet openings of the washing compartment SPB and the one or more inlet openings of the sorption compartment SB.

The fan unit LT is preferably embodied as an axial fan. It serves in forcing moist hot air LU to flow out of the washing compartment SPB through a sorption unit SE in the sorption compartment SB. The sorption unit contains reversibly dehydratable sorption drying material ZEO which can absorb and store moisture from the air LU guided through it which is sucked by the fan unit LT from the washing compartment SPB into the air-guiding channel LK and the adjoining sorption compartment SB. The sorption compartment SB has an outflow opening AO (see FIGS. 4,5) on the top side in the region of its housing GT close to the cover, said outflow opening being connected by means of an outlet element AUS through a through-insertion opening DG (see FIG. 13) in the base BO of the washing compartment SPB to the interior thereof. In this way, during a drying step of a dishwashing program for the drying of cleaned items, moist hot air LU can be sucked by means of the switched-on fan unit LT out of the interior of the washing compartment SPB through the outlet opening ALA into the inlet-end tube portion RA1 of the air-guiding channel LK and transported via the connecting section VA into the interior of the sorption compartment SB to be forced to flow through the reversibly dehydratable sorption drying material ZEO in the sorption unit SE. The sorption drying material ZEO in the sorption unit SE extracts during the respective drying step water from the moist air flowing through it such that downstream of the sorption unit SE dried air can be blown via the outlet element or exhaust element AUS into the interior of the washing compartment SPB. In this way, this sorption drying system TS provides a closed air-circulation system. The spatial arrangement of the various components of this sorption drying system TS is illustrated in the schematic perspective representation of FIG. 2 and the schematic side view of FIG. 3. In FIG. 3, the course of the base BO of the washing compartment SPB is additionally included in the drawing as a dashed-dotted line, which enables better illustration of the spatial/geometric proportions of the layout of the sorption drying system TS.

The outlet opening ALA is preferably arranged at a point above the base BO that in particular enables during the respective drying cycle during sorption the collection or suction of as much moist hot air LU as possible out of the washing compartment SB into the air-guiding channel LK without the risk of liquid or foam being able to enter the sorption compartment SB via the air-guiding channel. After a cleaning cycle, in particular a final rinse cycle with heated liquid, moist hot air collects preferably above the base BO, in particular in the upper half, of the washing compartment SPB. The outlet opening ALA lies preferably at a vertical position above the level of foam which can occur during regular washing or in the event of a malfunction. In particular, foam can be caused e.g. by detergent in the water during the cleaning cycle. The position of the discharge point or outlet opening ALA in particular will advantageously be chosen such that for the inlet-end tube portion RA1 of the air-guiding channel LK a still rising pathway on the side wall SW and/or back wall will be freely available. Placing the discharge opening or outlet opening preferably in the cover area, central area and/or upper area of the side wall SW and/or back wall RW of the washing compartment SPB also largely prevents the possibility of water being injected out of the sump in the base of the washing compartment or out of the liquid spraying system thereof through the outlet opening ALA of the washing compartment SPB during the respective cleaning or washing cycle directly into the air-guiding channel LK and subsequently entering the sorption compartment SB, which could otherwise render inadmissibly moist, partially or fully damage or even render unusable the sorption drying material ZEO thereof.

At least one heating device HZ for desorption and thus regeneration of the sorption drying material ZEO is arranged in the sorption compartment SB upstream of the sorption unit SE thereof, viewed in the direction of flow. The heating device HZ and the downstream sorption unit SE form a substantially vertical sorption column arrangement. The heating device HZ serves to heat air LU which can be driven by means of the fan unit LT through the air-guiding channel LK into the sorption compartment SB for the respective desorption process. This forcibly heated air absorbs the stored moisture, in particular water, from the sorption drying material ZEO as it flows through the sorption drying material ZEO. This water which is expelled from the sorption drying material ZEO is transported by the heated air via the outlet element AUS of the sorption compartment SB into the interior of the washing compartment. This desorption process can preferably take place when the heating of the wash liquor for a cleaning cycle or other wash cycle of a subsequent dishwashing program is required or is being carried out. The air heated by the heating device HZ for the desorption process, which air flows through the sorption material of the sorption compartment, can simultaneously be used for heating the respective wash liquor in the respective prewash cycle or cleaning cycle in the washing compartment SPB, which is energy saving. This type of heating can be effected alone or in support of conventional water heating.

Figure 2:
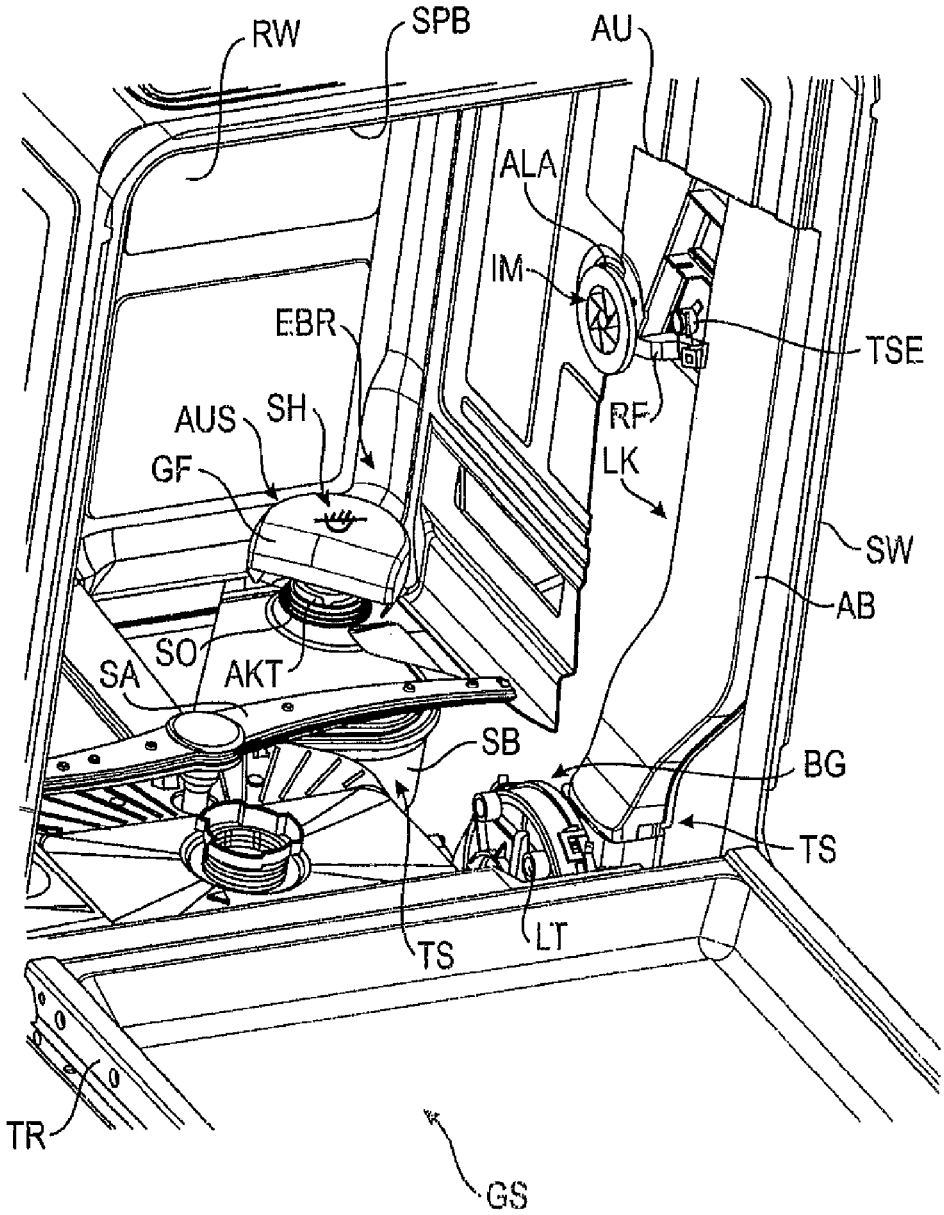
FIG. 2 shows schematically in perspective representation the open washing compartment of the dishwasher machine from FIG. 1 with components of the sorption drying system which are partially exposed, i.e. drawn in without a cover.
Figure 3:
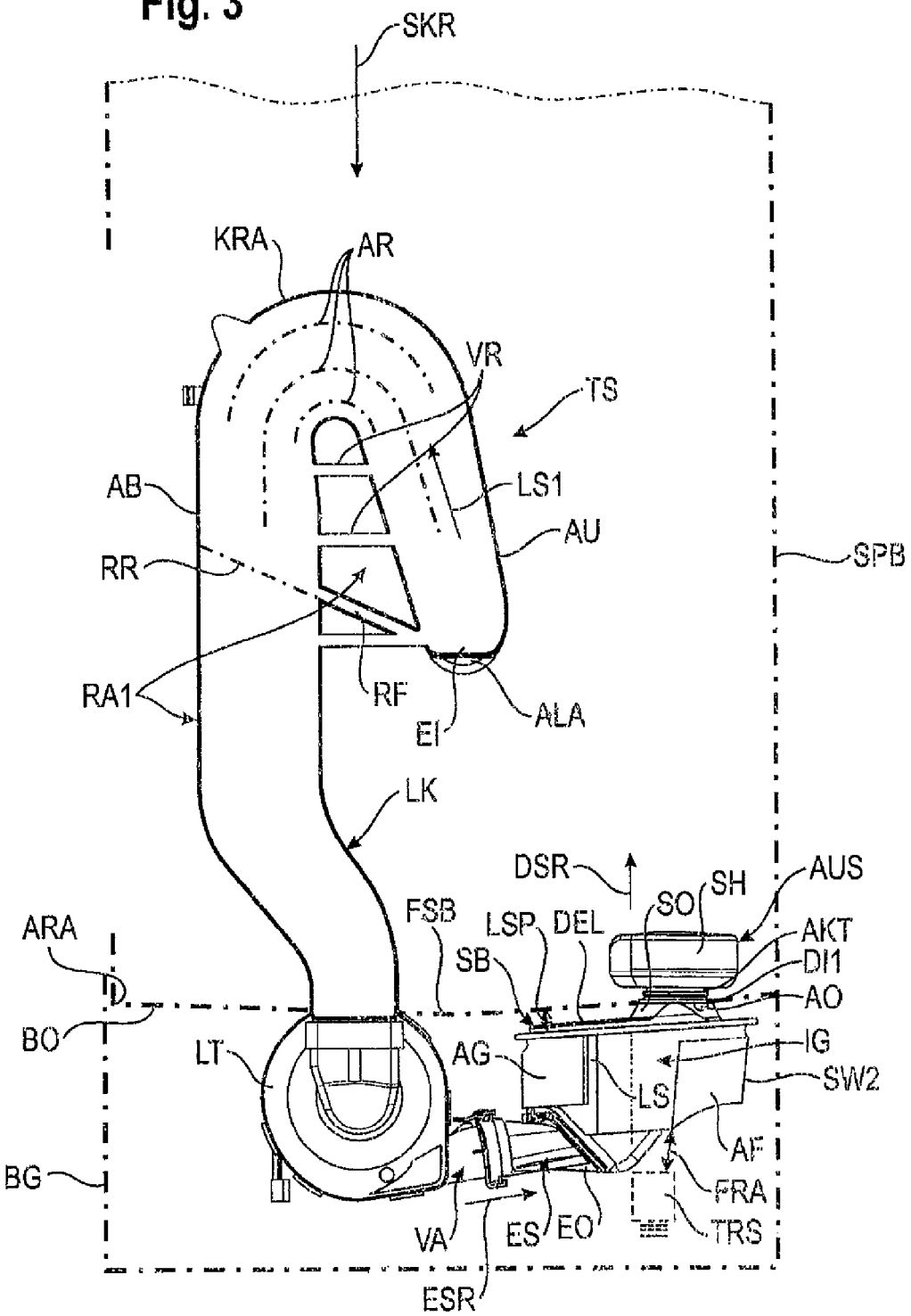
FIG. 3 shows in schematic side view the entirety of the sorption drying system from FIG. 1, 2, the components of which are accommodated partially externally on a side wall of the washing compartment and partially in a base module underneath the washing compartment.

FIG. 2 shows, with the door TR of the dishwasher machine GS from FIG. 1 open, the main components of the sorption drying system TS in the side wall SW and the base module BG partially in an exposed state in a perspective representation. FIG. 3 shows, to accompany this, the totality of components of the sorption drying system TS, viewed from the side. The inlet-end tube portion RA1 of the air-guiding channel LK leading to the fan unit LT comprises, starting from the vertical position of its inlet opening EI at the location of the outlet opening ALA of the washing compartment SPB a tube portion AU that is upwardly rising in relation to the direction of gravity and thereafter a tube portion AB that is downwardly descending in relation to the direction of gravity. The upwardly rising tube portion AU runs in the exemplary embodiment here on a somewhat oblique incline upward relative to the vertical direction of gravity SKR and passes into a curved portion KRA, which is convexly curved and forces with respect to inflowing air flow LS1 a reversal of direction of approximately 180° downward into the adjoining, substantially vertically downwardly descending, tube portion AB. This tube portion ends in the fan unit LT which is accommodated in the base module BG. The first upwardly rising tube portion AU, the curved portion KRA and the downstream, second, downwardly descending tube portion AB form in the exemplary embodiment here a flat channel having a substantially flatly rectangular cross-sectional geometric shape. The back wall and the front wall of the flat channel run substantially parallel to the positional plane of the side wall SW of the washing compartment. In particular, the back wall of the flat channel is mounted on the side wall SW and bears largely flatly against said side wall.

One or more flow-guiding ribs or drainage ribs AR are provided in the interior of the curved portion KRA, said ribs following the curved course thereof. In the exemplary embodiment, several arc-type drainage ribs AR are arranged substantially nested concentrically into one another and set at a transverse distance from one another, or at a gap from one another in the interior of the curved portion KRA. They also extend in the exemplary embodiment here into the rising tube portion AU and into the descending tube portion AB over part of their length. These drainage ribs AR are arranged in vertical positions above the outlet ALA of the washing compartment SPB and the inlet EI of the inlet-end tube portion RA1 of the air-guiding channel LK. These drainage ribs AR serve in particular during the sorption process in which steam is present in the washing compartment after the end of the final rinse cycle to absorb droplets of liquid and/or condensation from the air flow LS1 sucked out of the washing compartment SPB. In the region of the portion of the upwardly rising tube portion AU, the droplets of liquid collected on the flow-guiding ribs AR can drain in the direction of the outlet ALA. In the region of the downwardly descending tube portion AB, the droplets of liquid can drain from the flow-guiding ribs AR in the direction of at least one return rib RR. The return rib RR is provided at a point in the interior of the descending tube portion AB which lies higher than the outlet opening ALA of the washing compartment SPB and/or which lies higher than the inlet opening EI of the air-guiding channel LK. The return rib RR in the interior of the descending tube portion AB forms a drainage incline and aligns with a cross-connecting line RF in the direction of the outlet ALA of the washing compartment SPB. The cross-connecting line RF bridges the intermediate space between the arm of the upwardly rising tube portion AU and the arm of the downwardly descending tube portion AB. The cross-connecting line RF consequently connects the interior of the upwardly rising tube portion AU and the interior of the downwardly descending tube portion AB to one another. The gradient of the return rib RR and of the adjoining, aligned cross-connecting line RF is chosen in such a way as to ensure a return of condensation and/or other drops of liquid which drip down from the drainage ribs AR in the region of the descending tube portion AB into the outlet opening ALA of the washing compartment SPB. It is not therefore necessary to provide an additional separate condensation capturing and returning device in addition to the air-guiding channel.

The drainage ribs AR are preferably fitted on the inner wall of the air-guiding channel LK facing away from the washing compartment side wall SW because this exterior inner wall of the air-guiding channel is cooler than the inner wall of the air-guiding channel facing toward the washing compartment SPB. On this cooler inner wall condensation precipitates more intensely than on the inner wall of the air-guiding channel LK facing toward the side wall SW. Thus, it may suffice for the drainage ribs AR to be embodied as web elements which project from the outward lying inner wall of the air-guiding channel LK only over a partial depth or partial height of the total cross-sectional depth (i.e. viewed perpendicular to the side wall SW this is the total height) of the air-guiding channel embodied as a flat channel in the direction of the inward-lying inner wall of the air-guiding channel facing the side wall SW, such that viewed in the depth direction a cross-sectional gap relative to the air-through-flow remains. It may, however, optionally also be useful to embody the drainage ribs AR between the outward lying inner wall and the inward lying inner wall of the air-guiding channel as a continuous air-guiding rib. In this way, particularly in the curved portion KRA, the provision of a multiplicity of individual air-guiding channels separated from one another, enables a more targeted guidance and redirection of air to be achieved because, due to the narrower through-flow cross-sections of said channels, the through-flow velocity can be increased for the air mass flowing through in each case. Disruptive air turbulence is thus largely avoided. A desired volume of air can in this way be conveyed through the air-guiding channel LK embodied as a flat channel.

The return rib RR is preferably fitted as a web element on the inside of the outward-lying inner wall of the air-guiding channel LK, said web element projecting over a partial depth of the overall depth of the flatly embodied air-guiding channel LK in the direction of the inward-lying inner wall thereof. This ensures that an adequate passage cross-section remains free in the region of the return rib RR for the air flow LS1 to flow through. Alternatively, it can of course also be useful to embody the return rib RR as a continuous element between the outside inner wall and the inward-lying inner wall of the air-guiding channel LK and to provide in particular centrally located passage openings for the passage of air.

The drainage ribs AR and the return rib RR serve in particular to separate water droplets, detergent droplets, rinse aid droplets and/or other aerosols which are found in the air LS1 flowing in from the interior of the washing compartment and to return them through the outlet opening ALA into the washing compartment SPB. This is particularly advantageous in a desorption process when a cleaning step or other wash cycle involving the heating of wash liquor takes place simultaneously. The desorption process could otherwise be impaired namely because the sorption drying material would be rendered inadmissibly wet or moist by the introduction of such aerosols and liquid droplets. During the respective cleaning step or washing step, a relatively large amount of steam or mist may be located in the washing compartment SPB, in particular due to the spraying of wash liquor by means of the spray arms SA. Such steam and mist may contain water, detergent, rinse aid and/or optionally other cleaning substances finely distributed. For these dispersed liquid particles carried along in the air flow LS1, the drainage ribs AR form a separating device. Instead of drainage ribs AR, other separating means can alternatively also advantageously be provided, in particular structures having a multiplicity of edges such as e.g. wire meshes.

In particular, the obliquely upwardly or substantially vertically rising tube portion AU ensures that liquid droplets or even spray jets which are sprayed out by a spraying device SA such as, for example, a spray arm, during the respective cleaning cycle or other wash cycle are largely prevented from being able to reach the sorption drying material SEO of the sorption compartment SB directly via the sucked-in air flow LS1. Without this retention or this separation of liquid droplets, in particular mist droplets and steam droplets, the sorption drying material ZEO could be rendered inadmissibly moist and unusable for a sorption process in the drying step. In particular, premature saturation could occur due to the infiltration of liquid droplets such as e.g. mist droplets or steam droplets. The inlet-end rising branch AU of the through-channel and/or the one or more separating and capturing elements in the upper bend region and apical region of the curved portion KRA between the rising branch AU and the descending branch AB of the through-channel thus largely prevent water droplets, detergent droplets, rinse-aid droplets and mixed droplets, and/or other aerosol droplets from being able to pass further down beyond this barrier to the fan LT and from there into the sorption compartment SB. Of course, it is also possible to provide in place of the combination of rising tube portion AU and descending tube portion AB and in place of the one or more separating elements a differently embodied barrier arrangement with the same filtering function.

In summary, the dishwasher machine in the exemplary embodiment here comprises a drying device for drying items to be washed through sorption by means of reversibly dehydratable sorption drying material which is stored in a sorption compartment. Said sorption compartment is connected via at least one air-guiding channel to the washing compartment for generating an air flow. The air-guiding channel preferably has along its inlet-end tube portion a substantially flatly rectangular cross-sectional geometric shape. By this means it can advantageously be accommodated in a space-saving manner in the intermediate space between at least one outer wall of the washing compartment and an outer housing of the dishwasher machine. Viewed in the direction of flow, after its inlet-end tube portion, which lies over the outlet opening of the washing compartment, the air-guiding channel preferably passes in particular into a substantially cylindrical tube portion with which it opens into the fan unit. It is preferably manufactured from at least one plastic material. It is arranged in particular in the intermediate space between a side wall and/or back wall of the washing compartment and an outer housing wall of the dishwasher machine. The air-guiding channel advantageously comprises at least one upwardly rising tube portion. It extends upward starting in particular from the discharge opening of the washing compartment. It advantageously also comprises after the rising tube portion, viewed in the direction of flow, at least one downwardly descending tube portion. At least one curved portion is preferably provided between the rising tube portion and the descending tube portion. The curved portion can have in particular a greater cross-sectional area than the rising tube portion and/or the descending tube portion. One or more flow-guiding ribs for equalizing the air flow can advantageously be provided in the interior of the curved portion. At least one of the flow-guiding ribs can optionally extend beyond the curved portion into the rising tube portion and/or the descending tube portion. The one or more flow-guiding ribs are provided in particular in positions above the vertical position of the outlet of the washing compartment. The respective flow-guiding rib can extend from the channel wall facing the washing-compartment housing to the opposing channel wall of the air-guiding channel facing away from the washing-compartment housing over a partial depth length and partial cross-sectional width, preferably substantially continuously. In particular, at least one return rib can be provided in the interior of the descending tube portion on the channel wall facing the washing-compartment housing and/or channel wall of the air-guiding channel LK facing away from the washing-compartment housing at a point which lies higher than the inlet opening of the air-guiding channel. The return rib can usefully be connected to the inlet opening of the air-guiding channel via a cross-connecting line in the intermediate space between the rising tube portion and the descending tube portion for returning condensate. It preferably exhibits a gradient toward the inlet opening. The return rib can extend from the channel wall facing the washing-compartment housing to the opposing channel wall of the air-guiding channel facing away from the washing-compartment housing preferably only over a partial cross-sectional depth.

In FIG. 3, the descending branch AB of the air-guiding channel LK is introduced substantially vertically into the fan unit LT. The air flow LS1 which is sucked in is blown by the fan unit LT at the output end via a tubular connecting section VAS into an inlet connecting piece ES of the sorption compartment SB coupled thereto into the region in the vicinity of the base thereof. The air flow LS1 flows into the lower region of the sorption compartment SB with a, here in particular substantially horizontal, inflow direction ESR and switches to a different, here in particular substantially vertical, flow direction DSR with which it flows through the interior of the sorption compartment SB. This substantially vertical through-flow direction DSR runs from bottom to top through the sorption compartment SB. In particular, the inlet connecting piece ES steers the incoming air flow LS1 into the sorption compartment SB in such a way that said air flow is diverted from its inflow direction ESR in particular by approximately 90 degrees into the through-flow direction DSR through the sorption compartment SB.

Figure 10:
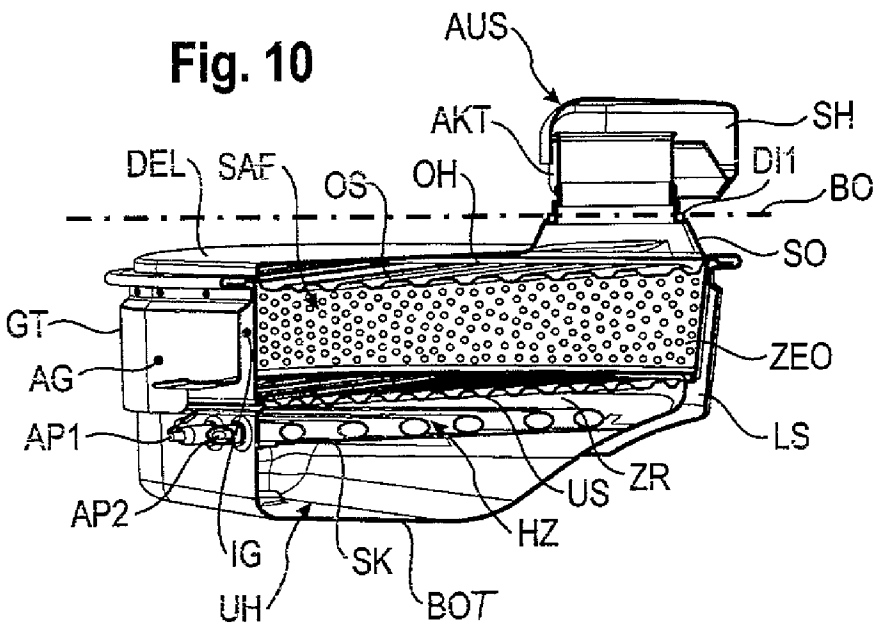
FIG. 10 shows in schematic perspective representation the internal structure of the sorption compartment of FIGS. 4, 5, 9 in a partially sliced state.
Figure 11:
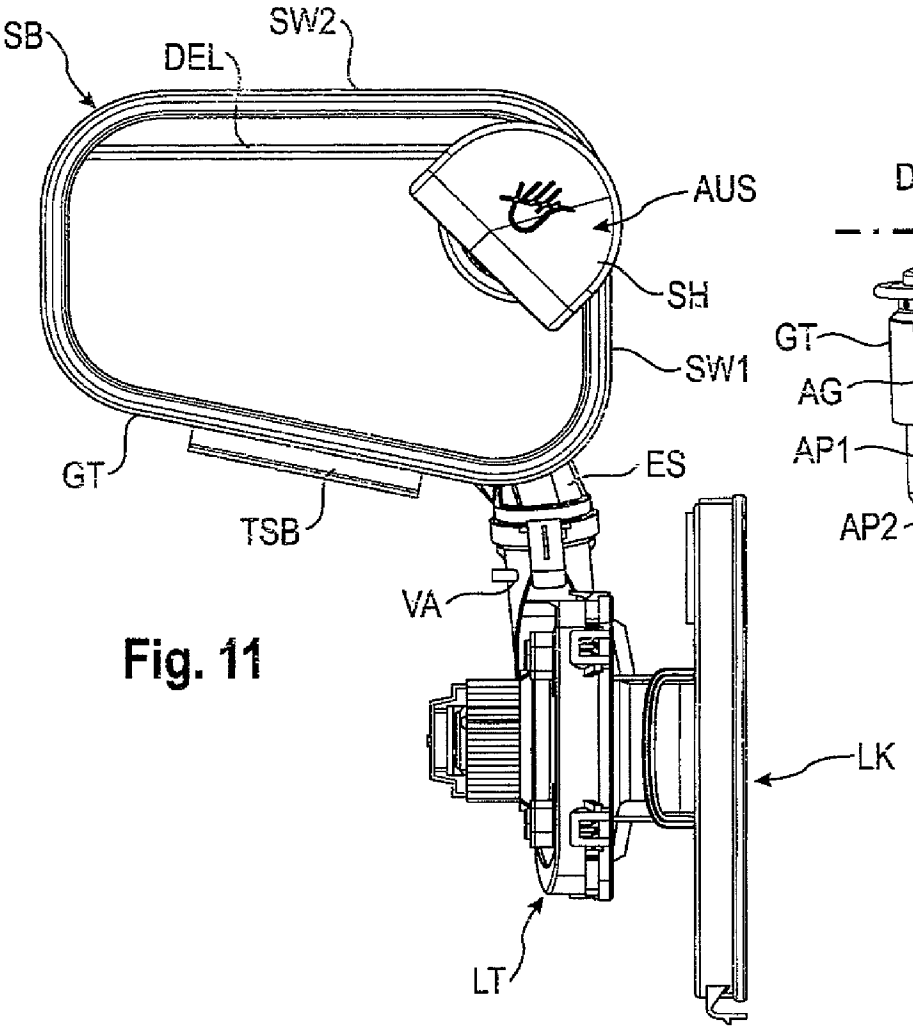
FIG. 11 shows in schematic plan representation, viewed from above, the entirety of the components of the sorption drying system of FIGS. 1 to 10, FIGS. 12 to 14 show schematically in various views the outlet element of the sorption drying system of FIGS. 1 to 3 as an individual item.
Figure 12:
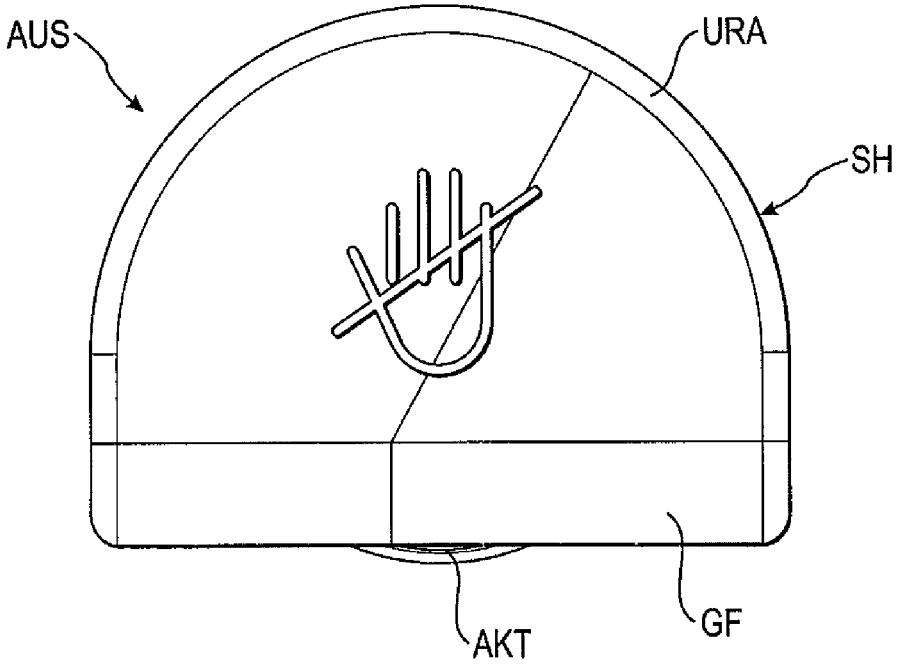

In accordance with FIG. 3, the sorption compartment SB is arranged underneath the base BO in the base module BG of the washing compartment SPB in a largely freely suspended manner such that for heat protection it has a predefined minimum gap distance LSP in relation to neighboring components and/or parts of the base module BG (see also FIG. 10). For the sorption compartment SB attached in a freely suspended manner below the base BO of the washing compartment or of the cover element of the base module BG, at least one transport securing element TRS is provided below said sorption compartment at a predefined clearance distance FRA such that the sorption compartment SB is supported from below in case the sorption compartment SB moves down together with the base BO during transport from its freely suspended position.

Expressed in general terms, the housing of the sorption compartment SB has a geometric shape such that circumferentially an adequate gap distance exists from the other parts and components of the base module BG as heat protection. For example, the sorption compartment SB has for this purpose on its housing wall SW2 facing the back wall RW of the base module BG an inwardly arched recess AF which corresponds to the geometric shape of the back wall RW of the washing compartment SPB facing it.

The sorption compartment SB advantageously comprises at least in the deposition region of its sorption unit SE, in addition to its pot-type inner housing IG closed with a cover element, at least one outer housing AG such that its overall housing GT is embodied there in a double-walled manner. Consequently, an air gap clearance LS is present between the inner housing IG and the outer housing AG as a thermal insulation layer.

The fact that the sorption compartment is embodied at least around the region in which its sorption unit is mounted, i.e. partially or wholly, in at least a double-walled manner, provides, in addition to or independently of its freely suspended mounting or accommodation, insulation and/or heat emission protection. This further overheating-protection measure thus serves firstly to protect any neighboring parts or components of the base module BG against inadmissibly high overheating or combustion. Secondly, the multi-walled nature of the sorption compartment has the function as insulation of preventing heat losses from the sorption unit to the environment, as a result of which energy efficiency during each desorption process, in which the sorption drying material is heated up with the aid of at least one air heating device in order to expel liquid, in particular water, can be increased compared with an uninsulated sorption compartment. Moreover, the volume of sorption drying material of the sorption unit can, due to the multi-walled nature of the sorption compartment, be heated up for desorption more uniformly than without thermal insulation, which is gentler on the sorption material. In addition, such a double-walled or, in general terms, multi-walled wall design of the sorption compartment is lower in cost and easier to manufacture than additional insulation mats. In the exemplary embodiment of FIG. 3, the sorption compartment SB comprises on its cover part DEL the freely downward projecting, cut-out outer wall AG which as an outer protective jacket covers the wall IG of the pot-type overall housing GT, which is closed at the top by means of the cover part DEL, in the region of the sorption unit SE at a predefinable transverse gap distance LS. As an alternative or addition to the folded-over outer wall AG, it is optionally also possible to provide an additional inner wall in the interior of the sorption compartment SB in addition to the housing wall IG thereof at least in the region of the sorption unit SE.

In addition to or independently of the multi-walled design of the sorption compartment, it can of course also be useful to provide, at least in the region of location of the sorption unit, around said unit externally on the housing of the sorption compartment and/or internally on the inner wall of the sorption compartment at least one heat-resistant insulation element. This may for example be thermally insulating fleeces or mats or such like.

Figure 13:
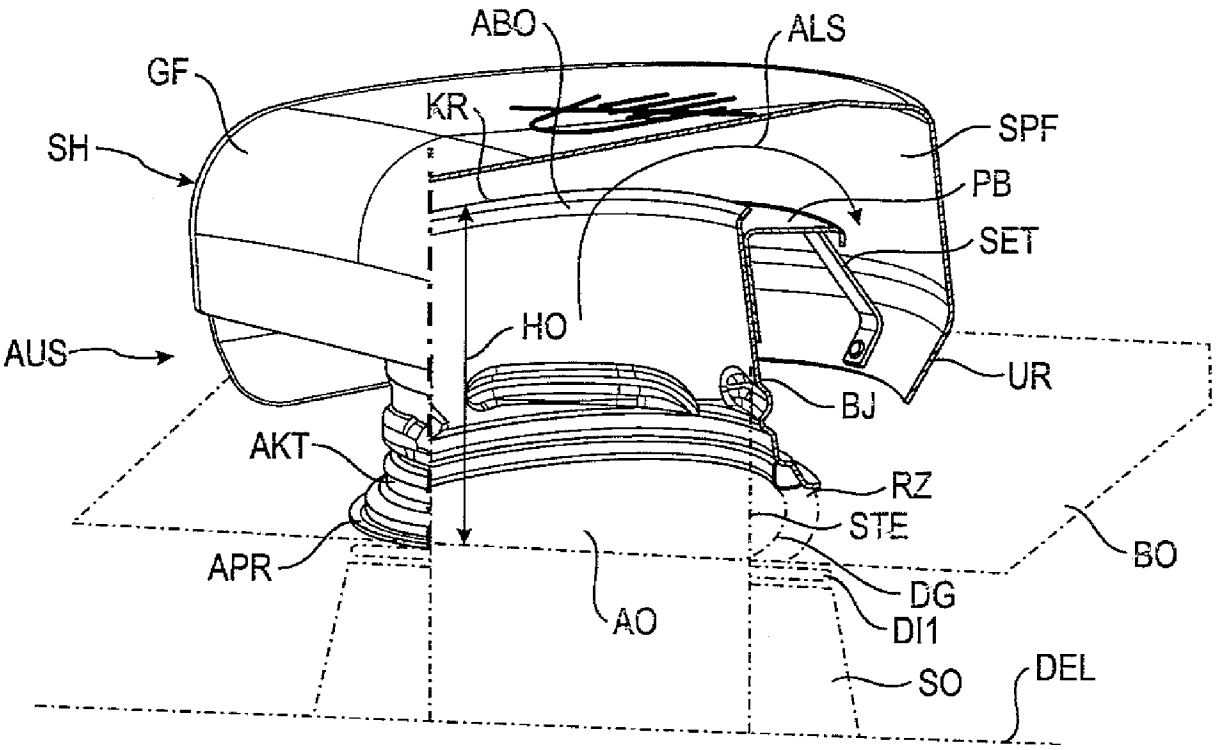

The sorption compartment SB is mounted on the underside of the base BO, in particular in the region of a through-opening DG (see FIGS. 3, 13) of the base BO of the washing compartment SPB. This is illustrated in particular in the schematic side view of FIG. 3. There, the base BO of the washing compartment SPB has starting from its outer edges ARA a gradient running toward a liquid collecting area FSB. This liquid collecting area FSB is assigned in particular to the location of the pump sump of the dishwasher machine. This is preferably provided roughly in the central area of the base BO. The sorption compartment is mounted on the base BO of the washing compartment in such a way that its cover part DEL runs substantially parallel to the underside of the base BO and at a predefined gap distance LSP therefrom. For positioning the sorption compartment SB in a freely suspended manner, a coupling connection is provided between at least one coupling component on the underside of the base, in particular a socket SO, of the sorption compartment SB and a coupling component on the top side of the base, in particular the outlet element AUS, of the sorption compartment SB in the region of a through-opening DG in the base BO of the washing compartment SB. As a coupling connection, a clamping connection, in particular, is provided. The clamping connection may be formed by a detachable connection, in particular screw connection, with or without bayonet catch BJ (see FIG. 13) between the coupling component of the sorption compartment SB on the underside of the base and the coupling component of the sorption compartment SB on the top side of the base. An annular edge zone RZ (see FIG. 13) around the through-opening DG of the base BO is clamped between the coupling or outlet component on the underside of the base such as e.g. the upwardly projecting socket SO on the cover part DEL of the sorption compartment SB, and the outlet element or spray protection component AUS arranged above the base BO when the two coupling components are in the assembled state. In FIG. 13, the base BO of the washing compartment SPB and the coupling or connection component SO on the underside of the base are, for the sake of drawing simplicity, indicated merely by dot-dash lines. The connection component SO on the underside of the base and/or the spray protection component AUS on the top side of the base projects respectively with its end-face end portion through the through-opening DG of the base BO. The base-side outlet part comprises the socket SO around the discharge opening AO of the cover part DEL of the sorption compartment SB. The spray protection component AUS on the top side of the base comprises an outflow connecting piece AKT and a spray protection hood SH. At least one sealing element DI1 is provided between the component AUS on the top side of the base and the component SO on the underside of the base.

In summary, the sorption compartment SB is thus arranged underneath the base BO of the washing compartment SPB in a largely freely suspended manner such that for heat protection it has a predefined minimum gap distance LSP in relation to neighboring components and parts of the base module BG. Below the sorption compartment SB a transport securing element TRS is additionally fixedly attached at a predefined clearance distance FRA to the base of the base module. This transport securing element TRS serves to brace, if necessary, from below the sorption compartment SB mounted in a freely suspended manner below the base BO of the washing compartment SPB, if said sorption compartment oscillates downward together with the base BO, for example during transportation, due to vibrations. This transport securing element TRS may, in particular, be formed by a metal bracket bent downward in a U-shaped manner which is fixedly mounted on the base of the base module. The sorption compartment SB has on the top of its cover part DEL the outflow opening AO. An upwardly projecting socket SO is fitted around the outer rim of this outflow opening AO. A cylindrical socket connection element STE is fitted in the approximately circular opening of this socket SO (see FIGS. 4, 5, 9, 13), said element projecting upwardly and serving as a counterpart to the outflow connecting piece or exhaust chimney connecting piece AKT to be fastened thereto. It preferably has an external thread with integrated bayonet catch BJ, which interacts appropriately with the internal thread of the exhaust chimney connecting piece AKT. The socket SO has on its top seating edge running concentrically around the socket connecting piece STE the sealing ring DI1. This is illustrated in FIGS. 3, 4, 9, 13. The sorption compartment SB rests firmly pressed with this sealing ring DI1 against the underside of the base BO. It is held by the height of the socket SO at a distance or spacing LSP from the underside of the base BO. The exhaust chimney connecting piece AKT is inserted down through the through opening DG of the base BO from the top of the base BO and screwed to the counterpart socket connecting piece STE and secured from opening by the bayonet catch BJ. The exhaust chimney connecting piece AKT abuts firmly, encircling the outer edge zone RZ of the base BO around the through-opening DG with its annular outer edge APR, because the outer edge zone RZ of the base BO around the through-opening DG is clamped in a liquid-tight manner between an encircling lower seating edge APR of the exhaust chimney connecting piece AKT and the upper seating edge of the socket AO by means of the sealing ring DI1 arranged there. Since the sealing ring DI1 presses on the base BO from the underside, it is protected against any impairments or damage by detergents in the washing liquid from ageing. A liquid-tight through-connection between the exhaust chimney connecting piece AKT and the socket SO is formed in this way. This simultaneously functions advantageously as a suspension device for the sorption compartment SB.

The fact that the socket SO projects by a socket height LSP above the remaining surface of the cover part DEL ensures that a gap clearance is present between the cover part DEL and the underside of the base BO. The base BO of the washing compartment SPB in the exemplary embodiment here from FIG. 3 runs, starting from its encircling edge zone with the side walls SW and the back wall RW, with a gradient in an obliquely inclined manner toward a preferably central liquid-collecting area FSB. The pump sump PSU of a circulating pump UWP may be located therebelow (see FIG. 16). In FIG. 3, this base BO running from the outside inward at an incline toward the lower lying collecting area FSB is drawn in dashed and dotted lines. The arrangement of the pump sump PSU with the circulating pump UWP sitting therein underneath the lower lying collecting area FSB can be seen from the plan-view image of the base module from FIG. 16. The sorption compartment SB is preferably mounted on the base BO of the washing compartment SPB such that its cover part DEL runs substantially parallel to the underside of the base BO and at a predefined gap distance LSP therefrom. To this end, the socket SO is placed on the socket connecting piece STE sitting therein obliquely at an appropriate angle of inclination relative to the surface normal of the cover part DEL.

According to FIGS. 4 to 10, the sorption compartment SB comprises a pot-type housing part GT which is closed by means of a cover part DEL. There is provided in the pot-type housing part GT at least the sorption unit SE comprising reversibly dehydratable sorption drying material ZEO. The sorption unit SE is accommodated in the pot-type housing part GT in such a way that an air flow LS2 can flow through its sorption drying material ZEO substantially in or against the direction of gravity SKR (see FIG. 3), said air flow LS2 being generated through diversion of the air flow LS1 brought about via the air-guiding channel LK. The sorption unit SE comprises at least one lower sieve element or grid element US as a lower, substantially horizontally arranged, air-permeable base element and at least one upper sieve element or grid element OS as an upper, substantially horizontally arranged, air-permeable cover element at a predefinable vertical distance H from one another (see in particular FIG. 9). The spatial volume between the two sieve elements or grid elements US, OS is to a large extent completely filled with the sorption drying material ZEO. At least one heating device HZ is provided in the pot-type housing part GT. Said heating device is, viewed in the through-flow direction DSR of the sorption compartment SB, provided in particular upstream of the sorption unit SE comprising the reversibly dehydratable sorption drying material ZEO. The heating device HZ is positioned in a lower cavity UH of the pot-type housing part GT between the base part BOT thereof and the sorption unit SE for collecting inflowing air LS1 from the air-guiding channel LK. The inlet opening EO for the air-guiding channel LK is provided in the region of the base part BOT. The discharge opening AO for the outlet element AUS is provided in the cover part DEL. A heat-resistant material, in particular metal sheet, preferably stainless steel or a stainless steel alloy, is preferably used for the cover part DEL and the pot-type housing part GT, i.e. in general terms, for all the parts of the overall housing of the sorption compartment. The cover part DEL closes off the pot-type housing part GT to a large extent hermetically. The circumferential outer edge of the cover part DEL is connected to the upper edge of the pot-type housing part GT only by a mechanical connection, in particular by a deforming connection, a joining connection, a latching connection, a clamping connection, in particular by a beaded connection or a clinched connection, which is simple in production engineering terms and ensures a permanently heat-resistant and tight connection. The pot-type housing part GT comprises one or more side walls SW1, SW2 (see FIG. 5) which run substantially vertically. It has an external contour which corresponds substantially to the internal contour of an installation area EBR provided for it, in particular in the base module BG (see FIG. 16). The two adjoining side walls SW1, SW2 have external surfaces which run substantially at right angles to one another. At least one side wall such as e.g. SW2, has at least one shape such as e.g. the recess AF (see FIG. 3) which is embodied in a substantially complementary manner to a shape on the back wall and/or side wall of the base module BG. The sorption compartment SB is provided in a rear corner area EBR between the back wall RW and an adjacent side wall SW of the dishwasher machine GS in a free space of the base module BG below the base BO.

Figure 4:
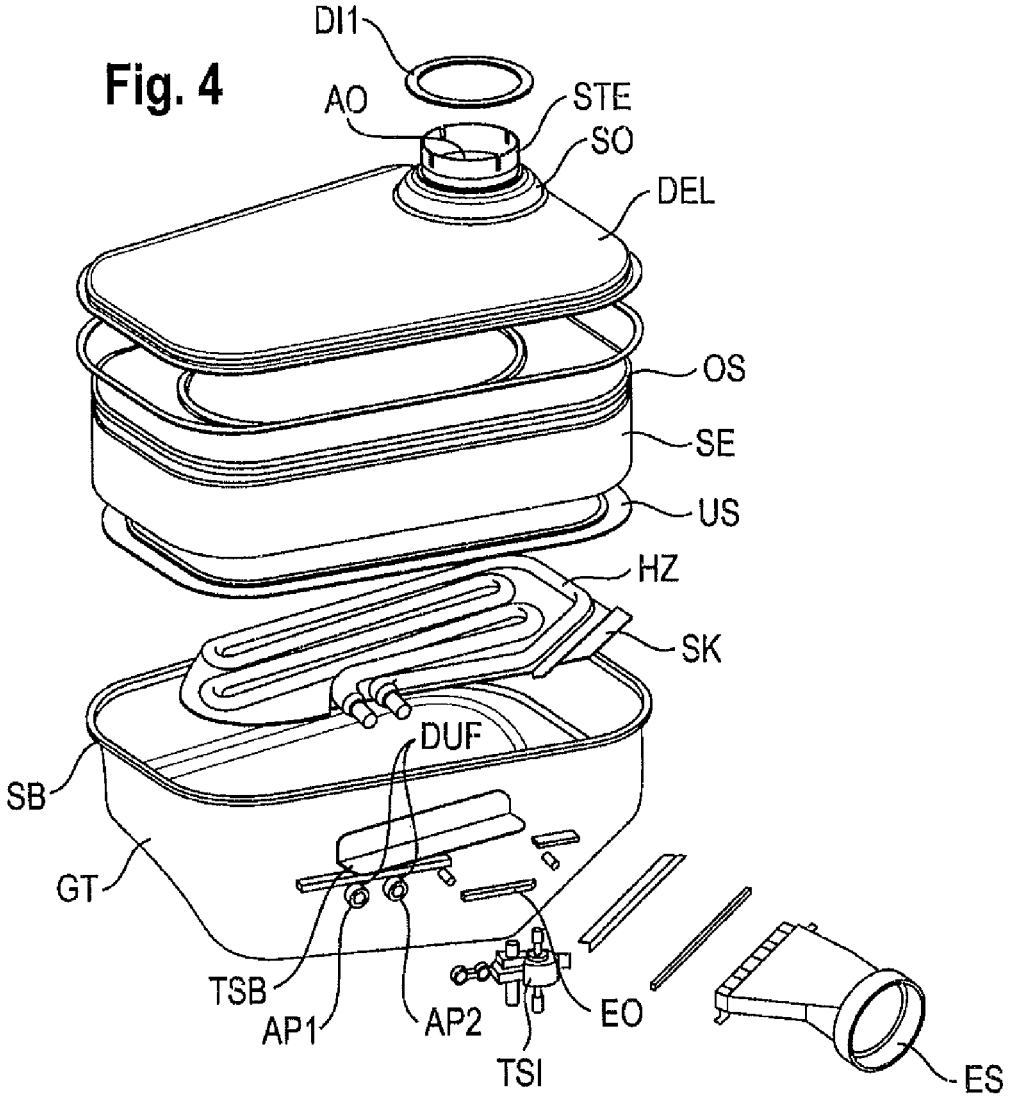
FIG. 4 shows as an individual item in each case schematically in exploded perspective representation various components of the sorption compartment of the sorption drying system from FIGS. 1 to 3.
Figure 5:
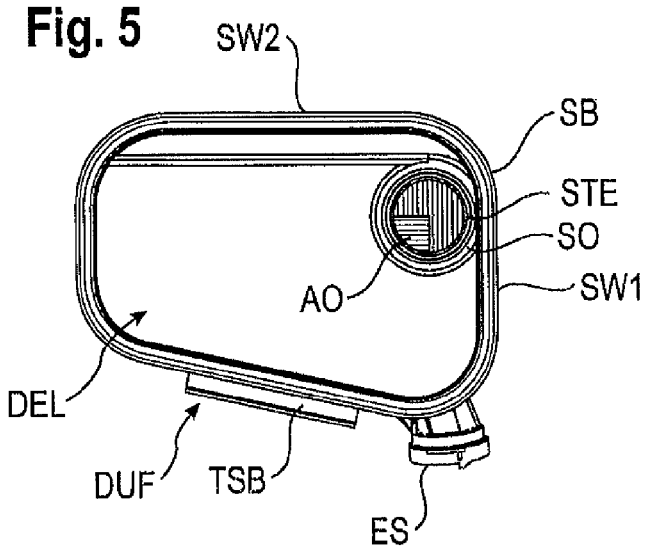
FIG. 5 shows schematically in plan view the sorption compartment from FIG. 4.
Figure 8:
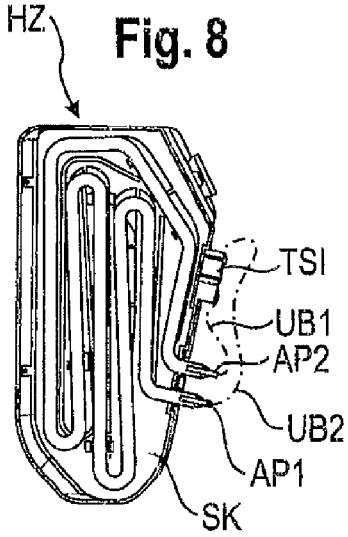
FIG. 8 shows in schematic plan representation, viewed from above, the coiled-tube heater from FIG. 7 which is arranged above the slotted sheet from FIG. 6.
Figure 9:
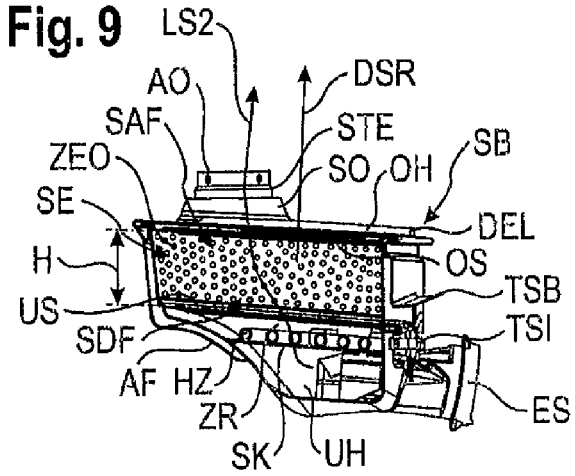
FIG. 9 shows in schematic sectional representation, viewed from the side, the sorption compartment of FIGS. 4, 5.
Figure 6:
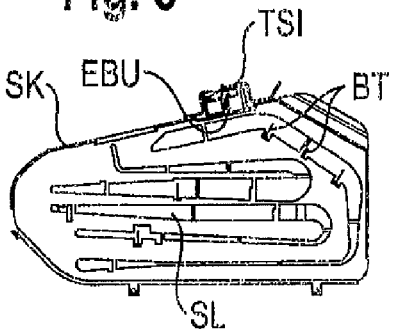
FIG. 6 shows in schematic plan view from below, as a component of the sorption compartment from FIG. 5, a slotted sheet for the flow conditioning of air which flows through sorption drying material in the sorption compartment.
Figure 7:
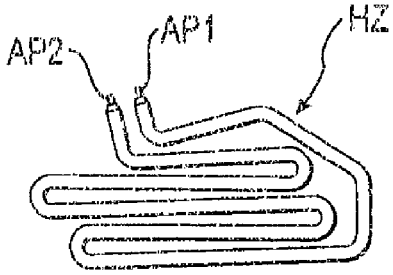
FIG. 7 shows in schematic plan view from below, as a further detail of the sorption compartment from FIG. 4, a coiled-tube heater for heating sorption drying material in the sorption compartment for the desorption thereof.

The pot-type housing part GT comprises at least one through-opening for at least one electrical contact element, in particular here two through-openings DUF for two electrical contact elements, preferably terminal poles AP1, AP2 (see FIGS. 4, 5). A drip protection sheet TSB is mounted for additional security in a roofed area above the through-opening DUF, at least over the extent thereof. The drip protection sheet TSB has a drainage incline. This drip sheet to a large extent prevents moisture or liquid from the interior of the washing compartment from being able to come into contact with the electrical contact elements, e.g. through any edge gap remaining in the event of a fault between the inner edge of the through-opening DG and the socket SO and/or connecting piece AKT of the coupling components SO, AUS despite sealing element DI1 or in any other way such as e.g. through a leak in the base BO or in a line of the liquid circulation system comprising the circulating pump UWP. This cover thus serves to provide electrical safety.

FIG. 4 shows in a schematic and perspective exploded view the various components of the sorption compartment SB in a disassembled state. Viewed in a vertical direction, the components of the sorption compartment SB are arranged in multiple positional planes above one another. This structural design, layered from bottom to top in a vertical direction, of the sorption compartment SB is illustrated in particular in the sectional view of FIG. 9 and in the sliced perspective representation of FIG. 10. The sorption compartment SB comprises the lower cavity UH close to the base for collecting inflowing air from the approximately horizontally incoming inlet connecting piece ES. Above this lower cavity UH sits a slotted sheet SK which serves as a flow-conditioning means for a coiled-tube heater HZ above it. The slotted sheet SK sits on a circumferential supporting edge around the interior of the sorption compartment SB. This supporting edge has a predefined vertical distance relative to the inner base of the sorption compartment SB for forming the lower cavity UH. The slotted sheet SK preferably has one or more clamping parts in order to clamp it laterally or on the side to a partial surface of at least one inner wall of the sorption compartment SB. A reliable securing in position of the slotted sheet SK can be provided by this means. In accordance with the view of the slotted sheet from below of FIG. 6, this slotted sheet has slots SL which substantially trace the course of the winding of the coiled-tube heater arranged over the slotted sheet SK. The slots or passages SL of the slotted sheet SK are embodied larger, in particular wider or broader, at those locations at which the air flow diverted into the sorption compartment SB with a substantially horizontally entering air flow LS1 into the substantially vertical through-flow direction DSR through the sorption compartment has a lower velocity than at those locations at which it has a greater velocity in the through-flow direction DSR through the sorption compartment SB. This achieves to a large extent an equalization of the local flow cross-sectional profile of the air flow LS2, which flows from bottom to top, in particular substantially in a vertical through-flow direction DSR, through the sorption compartment SB. Equalization of the local flow cross-sectional profile of the air flow is understood here in particular to mean that substantially the same volume of air passes through with approximately the same flow velocity substantially at every entry point of a through-flow surface of the sorption unit.

The coiled-tube heater HZ is arranged, viewed in the direction of flow-through DSR, with a predefined vertical clearance behind the slotted sheet SK. To achieve this, it can be held by means of a multiplicity of sheet parts BT which are embodied in a web-like manner at a vertical distance over the passages SL. These sheet parts BT (see FIG. 6) support preferably alternately from below and from above the run of the coiled-tube heater RZ. This makes it possible firstly for the coiled-tube heater HZ to be reliably secured in position above the slotted sheet SK. Secondly, warping of the slotted sheet SK which can occur due to the heat generated by the coiled-tube heater HZ is largely avoided. Viewed in the through-flow direction DSR, the coiled-tube heater HZ is followed by a free intermediate space ZR (see FIGS. 9, 10) until the upwardly, substantially from bottom to top, in particular substantially vertically, flowing air flow enters the intake cross-sectional area SDF of the sorption unit SE. This sorption unit SE comprises on the inlet side the lower sieve element or grid element US. The outlet-side upper sieve element or grid element OS is provided at a vertical distance H from this sieve element or grid element US, OS. For the two sieve elements US, OS supporting edges are provided in portions of or all around the inner walls of the sorption compartment in order to position and to hold the sieve elements US, OS in their assigned vertical position. The two sieve elements US, OS are preferably arranged parallel to one another at this predefined vertical distance H. Between the lower sieve element US and the upper sieve element OS, the sorption drying material ZEO is filled such that the volume between the two sieve elements US, OS is largely completely filled. When the sorption compartment SB is in the installed state, the inlet-end sieve element US and the outlet-end sieve element OS are arranged, relative to the vertically running central axis of the sorption compartment SB and relative to the through-flow direction DSR thereof, in substantially horizontal positional planes above one another at the predefined vertical distance H from one another. In other words, the sorption unit SE is therefore formed in the exemplary embodiment here by a filling volume of sorption drying material ZEO between a lower substantially horizontally arranged sieve element US and an upper substantially horizontally arranged sieve element OS, said sieve elements being connected to one another and enclosed all around by the side walls which, as the outer shell of the sorption unit, extend in a vertical direction, in particular in a through-flow direction DSR, of the sorption compartment SB. The sorption unit SE is consequently embodied in the shape of a sleeve or in the shape of a tube. The sorption drying material is supported on the lower sieve element SO and is held in position by said sieve element and the outer walls or the inner housing IG of the sorption compartment. Viewed in the through-flow direction DSR, the upper cavity OH for collecting outflowing air is provided above the sorption unit SE. This outflowing air LS2 is guided by the outlet AO of the socket connecting piece STE into the exhaust chimney connecting piece ATK, from where it is blown out into the interior of the washing compartment SPB.

In summary, the sorption drying material ZEO fills a fill volume between the lower, approximately horizontally arranged sieve element US and the upper, approximately horizontally arranged sieve element OS such that the flow intake cross-sectional area SDF and a flow discharge cross-sectional area SAF run substantially perpendicular to the through-flow direction DSR which runs substantially in a vertical direction. The lower sieve element US, the upper sieve element IOS and the sorption drying material ZEO supported therebetween each have penetration surfaces which are congruent in relation to one another for the through-flowing air LS2. This largely ensures that at each point in the volume of the sorption unit SE, the sorption drying material thereof can be subjected to approximately the same volume flow. During desorption, points of overheating and thus any overloading or other damage to the sorption drying material ZEO are in this way largely prevented. This ensures in particular that premature ageing of the sorption drying material over the overall product life time of the dishwasher machine is largely avoided. The sorption drying material can after each desorption be provided again with approximately the same material properties as in its original initial state for the next sorption drying process of a subsequent dishwashing program. During sorption, uniform absorption of moisture from the moist air to be dried and thus optimum use of the sorption drying material ZEO provided in the sorption unit SE is consequently enabled.

Flow-conditioning or flow-influencing of the flow LS2 rising from bottom to top in the through-flow direction DSR is performed by the slotted sheet SK such that substantially the same air volume flow flows around the coiled-tube heater substantially at each point of its longitudinal extent. The combination of slotted sheet and coiled-tube heater HZ arranged thereabove to a large extent ensures that the air flow LS2 can be heated largely uniformly during the desorption process upstream of the intake area of the lower sieve element US. The slotted sheet thereby provides for a largely uniform local distribution of the heated air volume flow viewed over the intake cross-sectional area SDF of the sorption unit SE.

In addition to or independently of the slotted sheet SK, it can optionally also be useful to provide a heating device outside the sorption compartment SB in the connecting section between the fan unit LT and the inlet opening EO of the sorption compartment SB in the air-guiding channel LK. Because the through-flow cross-sectional area of this tubular connecting section VA is less than the average cross-sectional area of the sorption compartment SB for an air flow, the air flow LS1 may, before it enters the sorption compartment SB, already be heated largely uniformly for the desorption process in advance. The slotted sheet SK can then optionally be omitted completely.

Particularly if the heating of the air is carried out by means of a heating device in the sorption compartment, it can optionally also be useful to provide, viewed in the through-flow direction DSR of the sorption compartment SB both upstream and downstream of the heating device HZ at least one flow-conditioning element in each case such that approximately the same air volume flow can flow at each point through the amount by volume of sorption drying material ZEO behind the inlet cross-sectional area SDF of the lower sieve element US. In this way, in particular firstly in the sorption process during which the heating device HZ is deactivated, i.e. is switched off, it is largely achieved that all the sorption drying material is to a large extent completely involved in the dehumidification of the through-flowing air LS1. Secondly, in an analogous manner, in the desorption process, in which the through-flowing air LS2 is heated up by the heating device HZ, stored water is caused to re-emerge from all the sorption drying material in the intermediate space between the two sieve elements US, OS such that at all points inside this spatial volume the sorption drying material ZEO can be made available, substantially fully dried and thus regenerated, for a subsequent drying process.

The through-flow cross-sectional area SDF of the sorption unit SE in the interior of the sorption compartment SB is embodied in the exemplary embodiment here to be greater than the average cross-sectional area of the inlet connecting piece ES on the end of the air-guiding channel LK or of the tubular connecting section VA. The through-flow cross-sectional area SDF of the sorption drying material is preferably embodied to be between 2 and 40 times, in particular between 4 and 30 times, preferably between 5 and 25 times greater, than the average cross-sectional area of the inlet connecting piece ES of the air-guiding channel LK with which said connecting piece opens into the intake opening EO of the sorption compartment SB.

In summary, it can therefore be particularly useful to provide one or more flow-conditioning elements SK in the sorption compartment SB and/or in a tube portion VA, ES of the air-guiding channel LK facing the sorption compartment SB at the inlet end, in particular downstream of at least one fan unit LT inserted into the air-guiding channel LK, said flow-conditioning elements comprising one or more air passages SL such that equalization of the local flow cross-sectional profile of the air flow LS2 is effected when flowing through the sorption compartment SB in the through-flow direction DSR thereof, said through-flow direction being oriented from bottom to top, in particular substantially vertically. Viewed in the through-flow direction DSR of the sorption compartment SB, at least one flow-conditioning element SK is provided in the lower cavity UH thereof at a vertical distance upstream of the heating device HZ. In the exemplary embodiment here a slotted sheet or perforated sheet is provided as the flow-conditioning element. The slots SL in the slotted sheet SK substantially trace the course of the winding of a coiled-tube heater HZ which is positioned as a heating device at a clearance distance above the slots SL in the slotted sheet. The slotted sheet is arranged substantially parallel to and at a clearance distance from the air intake cross-sectional area SDF of the sorption unit SE of the sorption compartment SE. Air passages, in particular slots SL, in the flow-conditioning element SK are embodied so as to be preferably larger at those locations at which the air flow LS1 entering the sorption compartment SB has a lower velocity after its diversion into the through-flow direction DSR of the sorption compartment SB than at those locations at which the air flow LS1 entering the sorption compartment SB has a greater velocity after its diversion into the through-flow direction DSR of the sorption compartment SB, so as to achieve equalization of the air flow which flows around the tube heater HZ.

Viewed in general terms, the sorption drying system exhibits the following specific flow conditions in the region of the sorption compartment: The air-guiding channel is coupled to the sorption compartment such that the entering air flow opens into the sorption compartment with an inflow direction which is here in particular substantially horizontal and passes into a through-flow direction which is different therefrom, here in particular substantially vertical, with which it flows through the interior of the sorption compartment SB. The outflow direction of the air flow exiting the sorption compartment preferably corresponds substantially to the approximately vertical through-flow direction. The inlet-end tube portion of the air-guiding channel opens into the sorption compartment such that its inflow direction is diverted into the forced through-flow direction of the sorption compartment, in particular by between 45° and 135°, preferably by approximately 90°, from its, here approximately horizontal, inflow direction. Viewed in the direction of flow, upstream of the sorption compartment at least one fan unit is inserted into the inlet-end tube portion of the air-guiding channel for generating a forced air flow in the direction of at least one intake opening of the sorption compartment.

The sorption compartment is embodied with a geometric shape such that air is forced to flow substantially in or against the direction of gravity through its sorption unit comprising the sorption drying material, said air being guided out of the washing compartment into the sorption compartment via the air-guiding channel. The sorption unit of the sorption compartment can preferably comprise at least one lower, substantially horizontally arranged, sieve element or grid element and at least one upper, substantially horizontally arranged, sieve element or grid element at a predefinable vertical distance from one another, the spatial volume between the two sieve elements or grid elements being largely completely filled with the sorption drying material. The intake cross-sectional area and the discharge cross-sectional area of the sorption unit of the sorption compartment can be chosen so as to be in particular substantially equal in size. The intake cross-sectional area and the discharge cross-sectional area of the sorption unit of the sorption compartment can furthermore usefully be arranged substantially congruently in relation to one another. The sorption compartment advantageously comprises, viewed in its direction of forced through-flow, at least one substantially vertical layering comprising a lower cavity and a sorption unit arranged thereabove, arranged downstream in the through-flow direction. It has in its lower cavity preferably at least one heating device. The sorption compartment can usefully also comprise above its sorption unit at least one upper cavity for collecting outflowing air. The sorption drying material usefully fills a fill volume in the sorption unit of the sorption compartment such that a flow intake cross-sectional area arranged substantially perpendicular to the through-flow direction and a flow discharge cross-sectional area arranged largely parallel thereto, i.e. each in a substantially horizontal positional plane, is formed. The sorption compartment preferably has on its upper cover part at least one outflow opening which is connected with the aid of at least one outflow component via a through-opening in the base of the washing compartment to the interior thereof.

According to an advantageous alternative development of the invention, the sorption compartment can be embodied in particular as a substantially perpendicularly arranged tube, in particular as a substantially vertically arranged cylinder or as a sleeve placed on end. In this way, a sorption column placed on end can be provided in particular with a heating device and a downstream sorption unit, for the sorption drying material of which a through-flow direction of air against the direction of gravity is predefined. This advantageously enables a relatively compact design variant with respect to the sorption compartment which requires only relatively little space.

The sorption drying material is advantageously supported in the sorption compartment in the shape of the sorption unit such that a substantially equal air volume flow rate can be applied to substantially each entry point to the through-through-flow cross-sectional area of the sorption unit. An aluminum- and/or silicon-oxide-containing, reversibly dehydratable, material, silica gel and/or zeolite, in particular type A, X, Y zeolite, is preferably provided, either singly or in any combination, as the sorption drying material. The sorption drying material is provided in the sorption compartment usefully in the form of a granular solid or granulate comprising a multiplicity of particles having a grain size substantially between 1 and 6 mm, in particular between 2.4 And 4.8 mm, as a fill, the fill height H of the particles corresponding to at least 5 times their grain size. The sorption drying material present as a granular solid or granulate is usefully present in the sorption compartment with a fill height H which corresponds to substantially 5 to 40 times, in particular 10 to 15 times the particle size of the granular solid or granulate. The fill height of the sorption drying material is preferably chosen so as to be substantially between 1.5 and 25 cm, in particular between 2 and 8 cm, preferably between 4 and 6 cm. The granular solid or granulate can preferably be composed of a multiplicity of substantially spherical particles. The sorption drying material ZEO embodied as a granular solid or granulate advantageously comprises an average fill density of at least 500 kg/m$^3$, in particular substantially between 500 and 800 kg/m$^3$, in particular between 600 and 700 kg/m$^3$, in particular between 630 and 650 kg/m$^3$, in particular preferably of approximately 640 kg/m$^3$.

In the sorption compartment, the reversibly dehydratable sorption drying material for absorbing a quantity of moisture transported in the air flow is usefully provided in a quantity by weight such that the quantity of moisture absorbed by the sorption drying material is lower than a quantity of moisture applied to the items to be washed, in particular a quantity of moisture applied in the final rinse step.

It can in particular be useful if in the sorption compartment the reversibly dehydratable sorption drying material is provided in a quantity by weight such that this is sufficient to absorb a quantity of moisture which corresponds substantially to a wetting quantity with which the items to be washed are wetted after the end of a final rinse step. The absorbed quantity of water corresponds preferably to between 4 and 25%, in particular between 5 and 15%, of the quantity of liquid applied to the items to be washed.

The sorption compartment usefully accommodates an amount by weight of sorption drying material ZEO of substantially between 0.2 and 5 kg, in particular between 0.3 and 3 kg, preferably between 0.5 and 2.5 kg.

The sorption drying material has in particular pores preferably of substantially between 1 and 12 Angstroms, in particular between 2 and 10, preferably between 3 and 8 Angstroms, in size.

It usefully has a water absorption capacity of substantially between 15 and 40 percent, preferably between 20 and 30 percent of its dry weight.

In particular, a sorption drying material is provided which can be desorbed at a temperature substantially in the range between 80° and 450° C., in particular between 220° C. and 250° C.

The air-guiding channel, the sorption compartment, and/or one or more additional flow-influencing elements are usefully embodied such that an air flow can be effected through the sorption drying material for the sorption and/or desorption thereof with a volume flow of substantially between 2 and 15 l/sec, in particular between 4 and 7 l/sec.

It can in particular be useful if at least one heating device is assigned to the sorption drying material, by means of which heating device an equivalent heat output of between 250 and 2500 W, in particular between 1000 and 1800 W, preferably between 1200 and 1500 W can be provided for heating the sorption drying material for the desorption thereof.

The ratio of heat output of at least one heating device which is assigned to the sorption drying material for the desorption thereof and air volume flow of the air flow which flows through the sorption drying material is preferably chosen so as to be between 100 and 1250 W sec/l, in particular between 100 and 450 W sec/l, preferably between 200 and 230 W sec/l.

In the sorption compartment, a through-flow cross-sectional area for the sorption drying material of substantially between 80 and 800 cm$^2$, in particular between 150 and 500 cm$^2$, is preferably provided.

The fill height of the sorption drying material via the intake cross-sectional area SDF of the sorption compartment SB is usefully substantially constant.

It is in particular useful to embody the sorption drying material in the sorption compartment so as to absorb a quantity of water of substantially between 150 and 400 mml, in particular between 200 and 300 ml.

Furthermore, for at least one component of the sorption drying system TS at least one thermal overheating-protection device is provided. The component can preferably be formed by a component of the sorption compartment SB. The thermal overheating-protection device can be affixed to the outside of the sorption compartment SB. In the exemplary embodiment here (see FIGS. 4, 6, 8, 9), at least one electrical temperature protection unit TSI is provided as a thermal overheating-protection device. It is assigned in the exemplary embodiment here to the heating device HZ which is accommodated in the sorption compartment SB.

The electrical temperature-protection unit TSI is provided in the exemplary embodiment of FIGS. 4, 6, 8 and 9 in an outside recess EBU on the inner housing IG of the sorption compartment SB in the region of the vertical position of the heating device HZ. It comprises at least one electrical thermal switch TSA and/or at least one fuse SSI (see FIG. 17). The electrical thermal switch TSA and/or the fuse SSI of the electrical temperature-protection unit TSI are respectively inserted, preferably in series, into at least one electrical power supply line UB1, UB2 of the heating device HZ (see FIG. 8).

It can furthermore be useful to provide at least one control device HE, ZE (see FIG. 16) with a monitoring logic which in the case of a fault in particular interrupts the power supply to the heating device HZ. For example, the exceeding of an upper temperature limit e.g. on the sorption compartment or in the washing compartment, constitutes a fault case.

Furthermore, the largely freely hanging suspension or a corresponding free installation of the sorption compartment, particularly underneath the base BO of the washing compartment SPB, can also serve as a thermal overheating-protection measure.

The thermal overheating-protection measure can furthermore comprise a positioning of the sorption compartment SB such that the sorption compartment has a predefined minimal gap distance LSP in relation to neighboring components and/or parts of a base module BG.

As a thermal overheating-protection device, there can be provided in addition to, or independently of, the measures indicated above at least in the region of the sorption unit SE of the sorption compartment SB at least one outer housing AG in addition to the inner housing IG of the sorption compartment SB. Between the inner housing IG and the outer housing AG, an air gap clearance LS is present as a thermal insulation layer. Expressed in general terms, the housing of the sorption compartment can thus be embodied on the outside and/or inside, at least around the region of the sorption unit comprising the sorption drying material, in a multi-walled, in particular double-walled, manner. In addition to or independently herefrom, the sorption unit can be surrounded in the interior of the sorption compartment and/or outside of the sorption compartment at least in the region of the sorption unit by at least one additional thermal insulation element.

Figure 17:
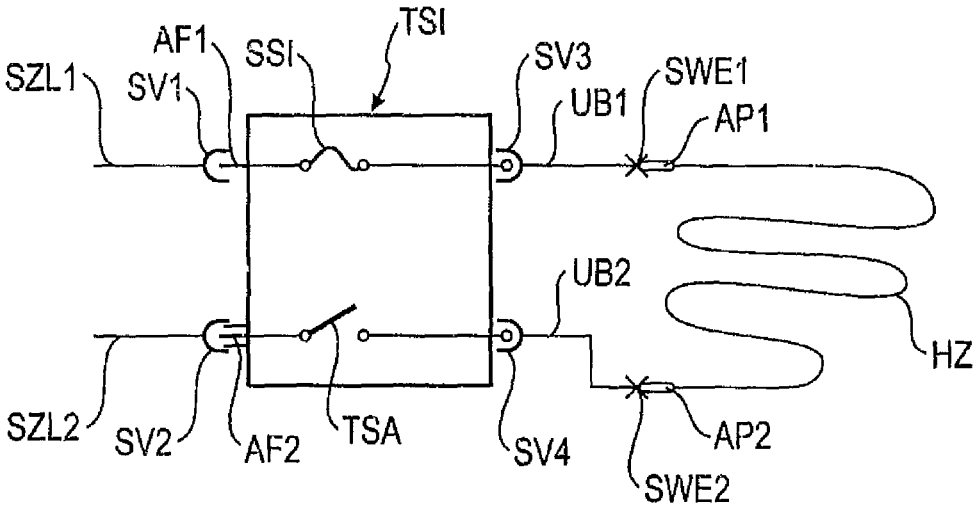
FIG. 17 shows in schematic representation the thermoelectric heat protection of the sorption compartment of FIGS. 4 to 10 of the sorption drying system of FIGS. 1 to 3, 11.

The heating device, here in particular the coiled-tube heater HZ of FIGS. 4, 7, 8, 9 comprises two terminal poles AP1, AP2 which are guided outwardly through corresponding through-openings in the housing of the washing compartment SB. Each terminal pole or terminal pin AP1, AP2 is preferably switched in series with an overheating-protection element. The overheating-protection elements are grouped in the temperature protection unit TSI which is arranged externally on the housing of the sorption compartment SB in the vicinity of the two pole pins AP1, AP2. FIG. 17 shows the overheating-protection circuit for the coiled-tube heater HZ from FIG. 8. The first bypass line UB1 is attached to the first rigid pole pin AP1 by means of a welded connection SWE1. In an analogous manner, the second bypass line UB2 is attached to the second rigid pole pin AP2 by means of a welded connection SWE2. By means of a plug-in connection SV4, the bypass line UB2 is electrically contacted to the thermal switch TSA. The bypass line UB1 is electrically connected via a plug-in contact SV3 to the thermoelectric fuse SSI. At the input end, a first power supply line SZL1 is connected via a plug-in connection SV1 to the outwardly guided terminal lug AF1 of the fuse element SSI. In an analogous manner, a second power supply line SZL2 is connected via a plug-in connection SV2 to the outwardly guided terminal lug AF2 of the thermal switch element TSA. The second power supply line SZL2 can, in particular, form a neutral conductor, while the first power supply line SZL1 can be a "live phase". The thermal switch TSA opens as soon as a first upper limit for the temperature of the coiled-tube heater HZ is exceeded. As soon as the temperature falls below this limit again, it closes again so that the coiled-tube heater HZ is heated up once again. If, however, a critical upper temperature limit which lies above the first upper limit for the coiled-tube heater is reached, then the fuse SSI melts through and the electric circuit for the coiled-tube heater HZ is permanently interrupted. The two temperature-protection elements of the temperature-protection device TSI are in largely close heat-conducting contact with the inner housing IG of the sorption compartment. They can be separately detached from one another if certain upper temperature limits specifically assigned to them are exceeded.

Figure 14:
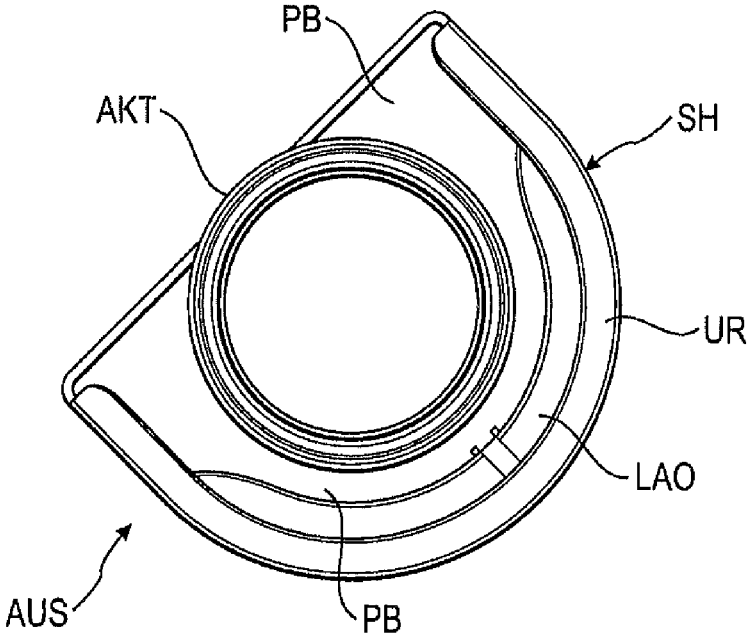

In accordance with FIGS. 10, 13, 14, the outflow connecting piece AKT which is connected to the outlet opening AO in the socket SO of the sorption compartment SB passes through the through-opening DG in the base BO of the washing compartment preferably in a corner region EBR of the washing compartment SPB which lies outside the area of rotation swept over by the spray arm SA. This is illustrated in FIG. 2. Expressed in general terms, the outflow connecting piece AKT of the outlet device AUS projects out of the base BO into the interior of the washing compartment SPB at a point which lies outside the area of rotation covered by the lower spray arm SA. The exhaust chimney connecting piece or the outflow connecting piece AKT is overlapped or covered over along its upper end portion by a spray-protection hood SH. The spray-protection hood SH covers over the outflow connecting piece AKT in an umbrella-like or mushroom-like manner. Said spray-protection hood is, viewed from above (see FIG. 12), completely closed on the top-side and on the side-wall side; it is also, in particular, also completely closed on its underside in a region facing the spray arm SA. The outlet device or the outlet element AUS is designed in such a way that it is possible to blow as much air as possible out of the sorption compartment via its outlet chimney connecting piece AKT into the interior of the washing compartment during each sorption or desorption process and simultaneously to provide by means of its spray-protection hood SH an air-exhaust-permeable cover such that penetration of wash liquor from the washing compartment into the interior of the sorption compartment is largely prevented. The spray-protection hood SH exhibits in the exemplary embodiment here in a first approximation the geometric shape of a semi-circular cylinder. It is represented schematically, viewed from above, in FIG. 12. On its top side, it has in transition zones GF, URA between its largely planar top side and its substantially vertically downwardly projecting side walls (viewed from inside to outside) convexly curved flattening portions GF (see FIG. 13). If a spray jet e.g. from the lower spray arm SA hits these transition zones GF, URA which are flattened out on the top edge or curved, then this spray jet pours like a film largely over the full surface of the spray-protection hood SA and cools this hood during the desorption process. In this way, material stresses or material damage to components in the interior of the washing compartment due to overheating are largely prevented.

The spray-protection hood SH is arranged at a free vertical distance opposite the outlet connecting piece AKT forming a free space or cavity. In order to prevent liquid during spraying with the lower spray arm SA from being able to pass through the discharge opening of the outflow connecting piece AKT into the sorption compartment SB, a lower edge zone UR of the semi-circular-cylinder-portion-like side wall of the spray protection hood SH is curved, arched or bent inwardly toward the outflow connecting piece AKT. This can be seen from FIG. 13. In addition, in the region of the top edge of the outflow connecting piece AKT, a spray-water deflecting element or shielding element PB, in particular a baffle plate, encircling said outflow connecting piece and projecting radially outwardly, is provided. This spray-water deflecting element projects radially outwardly into the intermediate space or gap space between the cylindrical outflow connecting piece AKT and the inner wall of the spray-protection hood SH. Between the outer peripheral edge of this shielding element PB and the inner wall of the spray-protection hood SH there remains a free through-opening for the air flow LS2 which flows out from the outflow connecting piece AKT in the direction of the top of the spray-protection hood SH and in doing so is diverted or deflected downwardly to the lower edge UR of the spray-protection hood SH, in particular by approximately 180°. The deflection path is labeled ALS in FIG. 13. The outwardly projecting shielding element PB is supported in the exemplary embodiment of FIG. 13 at individual circumferential points of its outer edge by means of web elements SET against the inner wall of the circumferential outer wall of the spray-protection hood SH in the form of a sleeve or ring segment portion.

FIG. 14 shows the spray-protection hood SH, viewed from below, together with the outflow connecting piece AKT. The shielding element PB shields the discharge opening of the outflow connecting piece AKT as a laterally or sidewardly projecting edge or web in a substantially circumferential manner. In particular, the shielding element PB closes off the underside of the spray-protection hood SH in the region of the rectilinear side wall facing the spray arm SA. Only in the semi-circularly bent portion of the spray-protection hood SH facing away from the spray arm between the shielding element PB and the externally concentrically arranged side wall of the spray-protection hood SH running in a radially offset manner is a gap clearance LAO cleared through which the air can flow out from the outflow connecting piece AKT into the interior of the washing compartment SPB. In the exemplary embodiment here from FIG. 14, the gap clearance LAO is substantially embodied in a sickle-like manner. The air flow LS2 is forced thereby onto the diverted path ALS which diverts it from its vertically upwardly oriented outflow direction downward to the lower edge UR of the spray-protection hood SH where it can exit only through the sickle-shaped gap clearance LAO in the shape of a segment of a divided circle in the lower region of the spray-protection hood SH. The outflow connecting piece AKT usefully projects to a height HO relative to the base BO such that its top edge lies higher than the level of a set total wash-tank volume or foam volume envisaged for a wash cycle.

The outflow element AUS which is affixed at the outlet end of the sorption compartment SB and projects into the interior of the washing compartment SPB is therefore usefully embodied such that the air flow LS2 exiting from it is directed away from the spray arm SA. In particular, the outflowing air flow LS2 is guided into a rear or back corner region between the back wall RW and the adjacent side wall SW of the washing compartment. This largely prevents spray-water or foam from being able to pass through the opening of the outflow connecting piece into the interior of the sorption compartment during the cleaning cycle or any other wash cycle. The desorption process could otherwise be impaired or completely nullified in this way. In addition, the sorption drying material could be permanently damaged by the washing liquid. For extensive tests have shown that the functionality of the sorption drying material in the sorption compartment can be largely retained or preserved over the life time of the dishwasher machine if water, detergent and/or rinse aid from the washing compartment is reliably prevented from penetrating the sorption compartment with the sorption drying material.

In summary, at least one outflow device AUS which is connected to at least one outflow opening AO of the sorption compartment SB is arranged in the interior of the washing compartment SPB such that air LS2 blown out from it is largely directed away from at least one spray device SA accommodated in the washing compartment SPB. The outflow device AUS is arranged outside the working area of the spray device SA. The spray device can be e.g. a rotating spray arm SA. The outflow device AUS is preferably provided in a rear corner region EBR between the back wall RW and an adjacent side wall SW of the washing compartment SPB. The outflow device AUS has in particular an exhaust opening ABO at a vertical distance HO above the base BO of the washing compartment SPB, which lies higher than the level of a set total wash-tank volume envisaged for a wash cycle. The outflow device AUS comprises an outflow connecting piece AKT and a spray-protection hood SH. The spray-protection hood SH has a geometric shape which slips over the exhaust opening ABO of the outflow connecting piece AKT. The spray-protection hood SH is slipped over the outflow connecting piece AKT such that air flowing up through the outflow connecting piece AKT out of the sorption compartment SB with a rising direction of flow can, after its exit from the exhaust opening ABO of the outflow connecting piece AKT, have a downwardly directing forced flow path ALS impressed upon it. The upwardly projecting outflow connecting piece AKT above the base BO of the washing compartment SPB is coupled to the terminal connecting piece STE on the cover part DEL of the sorption compartment SB arranged under the base BO. The spray-protection hood SH is, in its housing region GF facing the spray device SA, embodied in a closed manner both on the top and on the underside. The spray-protection hood SH overlaps the exhaust opening ABO of the outflow connecting piece AKT with an upper free space. The outflow connecting piece AKT has an upper, outwardly arched edge or circumferential collar KR. The spray-protection hood SH envelops an upper end portion of the outflow connecting piece AKT so as to form a gap clearance SPF between its inner wall and the outer wall of the outflow connecting piece AKT. The gap clearance SPF between the spray-protection hood SH and the outflow connecting piece AKT is embodied such that an air outflow path ALS out of the outflow connecting piece AKT is provided which is directed away from the spray device SA in the washing compartment SB. A spray-water deflecting element PB projecting into the gap clearance SPF is provided on the outflow-connecting piece AKT. A lower edge zone UR of the spray-protection hood SH is arched inwardly. The spray-protection hood SH has a rounded outer surface such that it causes a spray jet from the spray device SA which strikes it to pour over its surface like a film. This serves to cool the outlet device AUS.

It can optionally of course also be useful to provide a plurality of such outlet devices of the sorption drying system in the washing compartment.

Figure 15:
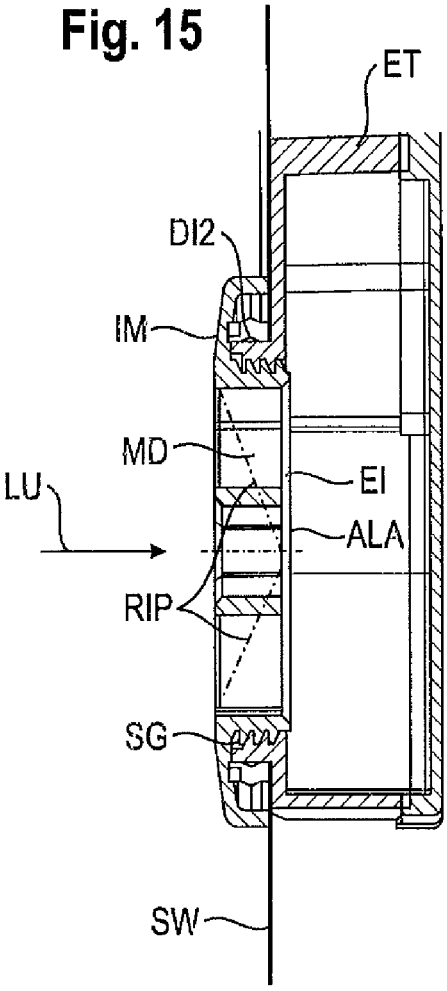
FIG. 15 shows in schematic sectional representation, viewed from the side, the inlet element of the sorption drying system of FIGS. 1 to 3 as an individual item.

FIG. 15 shows a schematic longitudinal representation of the fixing of the inlet-end, frontal end portion ET of the air-guiding channel LK in the region of the outlet opening ALA in the side wall SW of the washing compartment SPB of FIG. 2. The frontal end portion ET of the air-guiding channel LK projects into the interior of the washing compartment SPB such that a collar edge is formed circumferentially projecting perpendicularly in relation to the side wall SW. This collar edge has an internal thread SH. An annular inlet element or fixing element IM with an external thread is screwed into this internal thread SG. It therefore functions as a fixing element for holding the end portion ET. This annular fixing element has a toroidal encircling receiving chamber for a sealing element DI2. This sealing element DI2 seals an annular gap between the outer edge of the inlet-end frontal end portion ET of the air-guiding channel LK and the fixing element. The fixing element in the exemplary embodiment here is formed in particular by a cap-nut-like threaded ring which is screwed to the inlet-end frontal end portion ET of the air-guiding channel LK. In the exemplary embodiment, the annular fixing element or inlet element IM has a central through passage MD through which air LU can be sucked out of the interior of the washing compartment SPB into the air-guiding channel LK.

It can optionally also be useful to provide in or in front of the intake opening MD of the inlet-end tube portion ET of the air-guiding channel LK at least one ribbed engagement protection which has between its engagement ribs RIP freely passable gaps for the inflow of air LU out of the washing compartment. These ribs RIP are indicated in FIG. 15 by dashed-dotted lines. These ribs can also serve as a screwing aid for screwing the air inlet element IM into the internal thread of the end portion of the air-guiding channel.

Viewed in general terms, it can optionally also be useful to provide a sorption drying system which comprises a plurality of sorption units or sorption columns with associated heating devices in a common sorption compartment or in a plurality of separate sorption compartments. These sorption columns or their sorption compartments can both be switched in series and coupled to one another as parallel strands of the sorption drying system. This plurality of sorption columns arranged in parallel or in series can usefully be connected via one or more air-guiding channels to one or more outlet openings of the washing compartment for sucking air out of the washing compartment and/or to exhaust openings of one or more outlet devices for blowing out air into the washing compartment.

Figure 16:
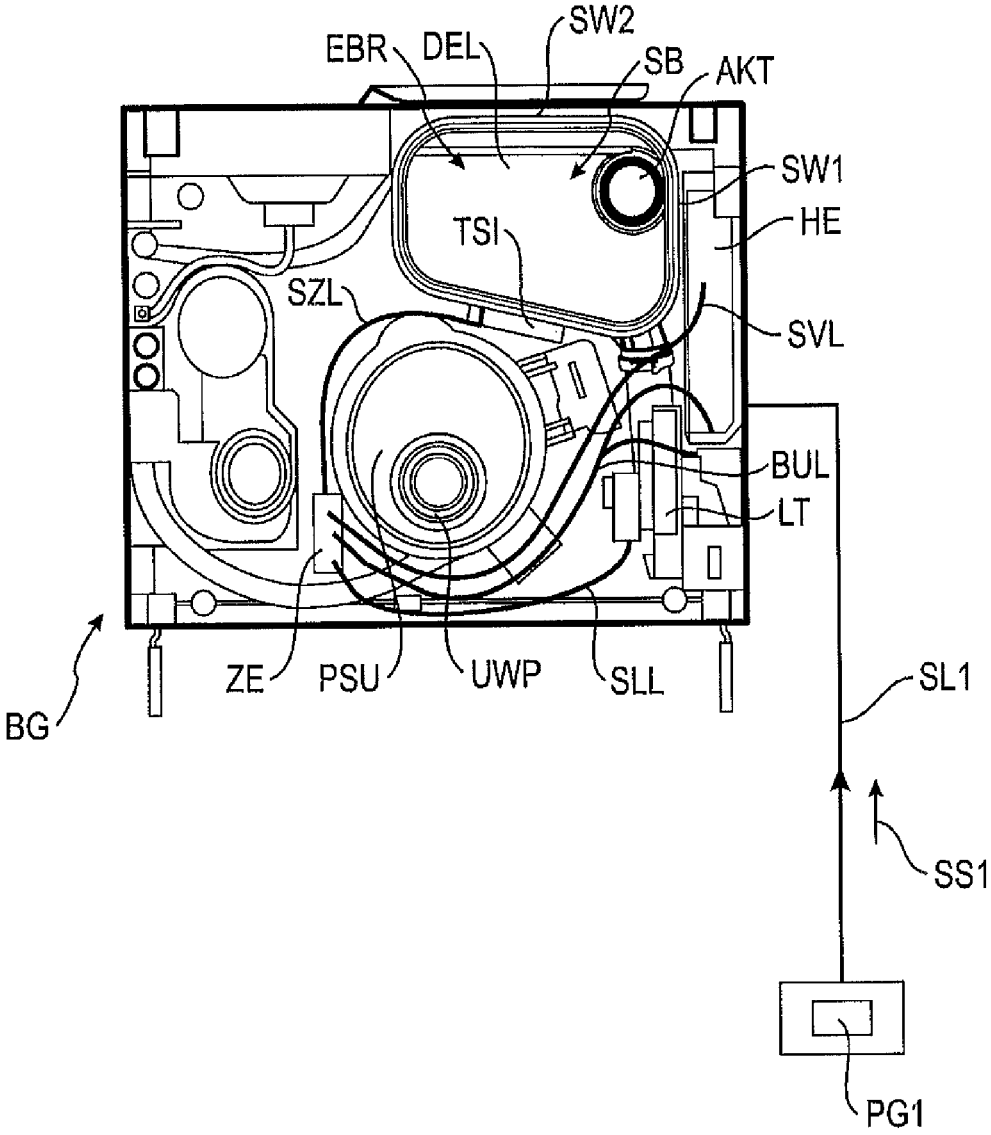
FIG. 16 shows in schematic plan representation, viewed from above, the base module of the dishwasher machine from FIG. 1 and FIG. 2.

FIG. 16 shows in schematic plan view representation the base module BG. It comprises in addition to the fan unit LT, the sorption compartment SB, the circulating pump UWP, etc. a main control device HE for the control and monitoring thereof. The heating device HZ of the sorption compartment SB is also regulated for the respective desorption process by means of at least one control device. This control device is formed in the exemplary embodiment here by an additional control device ZE. It serves to interrupt or switch through the power supply line SZL to the heating device HZ as required. The additional control device ZE is controlled from the main control device HE via a bus line BUL. A power supply line SVL runs from the main control device HE to the additional control device ZE. This additional control device also controls via a control line SLL the fan unit LT. The power supply line to the fan unit LT can in particular also be integrated into the control line SLL.

Also connected to the main control device HE via a signal line is at least one temperature sensor TDE (see FIG. 2) which delivers measurement signals to the main control device which represent the temperature in the interior of the washing compartment. The temperature sensor TSE is suspended between stiffening ribs VR (see FIG. 3) in the intermediate space between the two arms AU, AB of the inlet-end tube portion RA1 of the air-guiding channel LK. It is thereby brought into contact with the side wall SW of the washing compartment SPB.

As soon as a cleaning cycle is now started, the main control device HE simultaneously switches on the additional control device ZE via the bus line BUL such that an electrical voltage is applied via the power connection line SZL to the pole pins AP1, AP2 of the heating device HZ if a desorption process is desired. As soon as a certain predetermined critical upper temperature limit has been reached during the desorption process in the interior of the washing compartment SPB, which the main control device HE can determine e.g. via the measurement signals of the temperature sensor TSE, it can give the instruction to the additional control device ZE via the bus line BUL to withdraw the voltage on the power supply line SZL and thereby to switch off the heating device HZ and, optionally simultaneously or offset by a predefinable time span, the fan unit LT, i.e. the complete sorption drying device TV. In this way, the desorption process for the sorption drying material in the sorption compartment can be terminated in a safe manner if a fault occurs, in particular e.g. overheating of the sorption compartment with the sorption material, of the heating device assigned thereto, or of the interior of the washing compartment during the desorption process. In a corresponding manner, the main control device HE can also instruct the additional control device ZE in another fault case to switch off the heating device. Such another fault case may for example be a malfunction or interruption of the communication connection on the data bus BUL. Optionally, the additional control device ZE can also switch off the heating device HE and/or the fan unit LT independently or autonomously, i.e. independently of the main control device HE, if a fault case occurs during the respective desorption process.

It can optionally be useful to provide for a person operating the dishwasher machine the option of activating or deactivating the sorption drying system TS through activation or deactivation of a specially provided program button or through corresponding selection of a program menu. This is illustrated schematically in FIG. 16 in that included in the drawing is a program button or a program menu item PG1 which gives appropriate activation or deactivation signals for switching on and switching off the sorption drying system TE via a control line SL1 by means of control signals SS1 to the control logic HE.

In particular, a first selection button for selecting an "Energy" or "Sorption operation" program variant can be provided in the control panel. In this program, the emphasis is on saving energy. This is achieved in that during the final rinse cycle no heating at all is carried out by means of a continuous-flow heater and the drying of the items to be washed, in particular of the dishes, is effected solely with the aid of the sorption drying system TS.

It can optionally be useful in particular, in addition to pure sorption drying, to heat the interior of the washing compartment during the final rinse cycle through final rinse liquid heated by means of a continuous-flow heater. It can advantageously be sufficient if the transfer of heat to the items to be dried which is effected by means of the final rinse cycle is achieved with lower use of energy than is the case with no sorption drying. For electrical heat energy can, through sorption of air humidity, be saved by means of the sorption drying system now used. Thus, improved drying of wet and moist items to be washed can be achieved both by means of so-called "intrinsic-heat drying" and also by means of sorption drying, i.e. through a combination or addition of the two drying types.

In addition to or independently of the "Energy" button, a further "Drying performance" button can be provided in the control panel of the dishwasher machine which increases the blower runtime of the fan unit. Improved drying of all dishes can be achieved by this means.

In addition to or independently of the above special buttons, a further "Program runtime" button can be provided. If the sorption drying system is switched on, the program runtime can be reduced compared with conventional drying systems (without sorption drying). In addition to the heating of the respective wash liquor by means of a desorption process, the wash liquor can optionally be heated by means of a continuous-flow heater in the pump sump of the dishwasher machine in the prewash phase and/or cleaning phase. In addition to or independently hereof, the runtime during cleaning can be further shortened by increasing the spray pressure by increasing the motor speed of the circulating pump. Furthermore, the drying time can also be further shortened by increasing the final rinse temperature.

In addition to or independently of the previous specific buttons, an actuation button with the function "Influence the cleaning performance" button can be provided. By actuating this button, the cleaning performance can be enhanced over the same runtime without energy consumption being increased compared to a dishwasher machine without a sorption drying system. For heat energy for heating a desired total quantity of liquid in the wash tank can be saved in that, during a prewash and/or cleaning cycle, the desorption process is started at the same time and hot air, laden with a quantity of water discharged by the sorption drying material, passes into the washing compartment as a result.

The invention claimed is:

1. A dishwasher, comprising:

a washing compartment;

an air-guiding channel; and a sorption drying system to dry items to be washed, the sorption drying system having a sorption compartment with reversibly dehydratable sorption drying material, wherein the sorption compartment is connected to the washing compartment by the air-guiding channel for passage of an air flow; wherein:

the sorption compartment has a sorption unit having the sorption drying material;

the sorption compartment has a geometric shape such that the sorption unit is provided with a default through-flow direction for the air flow substantially in or against the direction of gravity; and the air-guiding channel is coupled to the sorption compartment such that the air flow opens into the sorption compartment with an inflow direction and switches to the default through-flow direction prior to the sorption drying material due at least in part to a surface within the sorption compartment, angled between horizontal and vertical, that deflects the air flow.

2. The dishwasher of claim 1, wherein the dishwasher is a household dishwasher.

3. The dishwasher of claim 1, wherein the sorption unit is arranged in the sorption compartment such that the air flow out of the washing compartment flows through a fill volume of the sorption drying material in a substantially vertical through-flow direction against the direction of gravity.

4. The dishwasher of claim 1, wherein the sorption compartment has a through-flow space; and wherein the sorption compartment is embodied and arranged such that a substantially vertical through-flow direction is imposed upon the through-flow space of the sorption compartment.

5. The dishwasher of claim 1, wherein the sorption compartment has one of a substantially pot, tubular, sleeve, and cylindrical shape.

6. The dishwasher of claim 1, wherein the sorption compartment has one of at least one side wall and at least one casing which is one of partially and wholly arranged substantially in a vertical positional plane.

7. The dishwasher of claim 6, wherein the sorption compartment has a substantially horizontally arranged base part and a substantially horizontally arranged cover part.

8. The dishwasher of claim 1, wherein the sorption drying material in the sorption unit of the sorption compartment fills a fill volume which has a flow intake cross-sectional area arranged substantially perpendicularly to the through-flow direction and a flow discharge cross-sectional area arranged substantially parallel to the through-flow direction.

9. The dishwasher of claim 1, wherein the sorption compartment has a housing jacket; wherein the interior of the housing jacket of the sorption compartment has at least one substantially horizontally arranged lower air-permeable base element as an integral part of the sorption unit; and wherein the sorption drying material of the sorption unit is supported on the lower air-permeable base element.

10. The dishwasher of claim 9, wherein the housing jacket forms a peripheral side-casing around the lower air-permeable base element such that the sorption drying material on the lower air-permeable base element is circumferentially laterally enclosed beyond a predetermined layer height.

11. The dishwasher of claim 9, wherein the interior of the housing jacket of the sorption compartment has an upper air-permeable cover element which is positioned at a predetermined layer height from the lower air-permeable base element and which is arranged substantially horizontally as an integral part of the sorption unit.

12. The dishwasher of claim 11, wherein the sorption compartment has a lateral housing jacket; wherein the sorption unit of the sorption compartment has one of a lower sieve element and a lower grid element which is arranged substantially horizontally as the lower air-permeable base element and one of an upper sieve element and an upper grid element which is arranged substantially horizontally as the air-permeable cover element at a predefined vertical distance from one another; and wherein a spatial volume between the two substantially horizontally arranged one of the sieve elements and the grid elements and the lateral housing jacket of the sorption compartment is filled essentially completely with the sorption drying material.

13. The dishwasher of claim 1, wherein the sorption unit of the sorption compartment has an intake cross-sectional area and a discharge cross-sectional area; and wherein the intake cross-sectional area and the discharge cross-sectional area of the sorption unit are substantially equal in size.

14. The dishwasher of claim 13, wherein the intake cross-sectional area and the discharge cross-sectional area of the sorption unit of the sorption compartment are arranged substantially congruently in relation to one another.

15. The dishwasher of claim 1, wherein the sorption unit has a through-flow cross-sectional area; and wherein the sorption drying material is supported in the sorption compartment in form of the sorption unit such that substantially each entry point of the through-flow cross-sectional area of the sorption unit is subjected to a substantially equal air volume flow rate.

16. The dishwasher of claim 1, wherein the sorption compartment, when viewed in the through-flow direction of the sorption compartment, has at least one substantially vertical layered arrangement including a lower hollow cavity and the sorption unit; and wherein the sorption unit is arranged above the lower hollow cavity and, in the through-flow direction, downstream of the sorption compartment.

17. The dishwasher of claim 1, further comprising a heater which is at least one of:

arranged in the air-guiding channel upstream of the sorption compartment when viewed in the direction of air inflow; and arranged upstream of the sorption unit of the sorption compartment in a housing of the sorption compartment when viewed in the through-flow direction of the sorption compartment.

18. The dishwasher of claim 17, wherein, when viewed against the direction of gravity, the sorption compartment has a substantially vertical layered arrangement including the heater and the sorption unit downstream of the heater.

19. The dishwasher of claim 17, wherein the sorption compartment has a base and a lower cavity; and wherein the heater is in the lower cavity close to the base of the sorption compartment.

20. The dishwasher of claim 17, wherein, when viewed against the direction of gravity, an intermediate space is provided between the heater and the sorption unit is downstream of the heater when viewed in the through-flow direction.

21. The dishwasher of claim 1, wherein, when viewed in the through-flow direction, the sorption compartment has an upper cavity above the sorption unit of the sorption compartment to collect outflowing air.

22. The dishwasher of claim 1, wherein the inflow direction is substantially horizontal; and wherein the through-flow direction is substantially vertical.

23. The dishwasher of claim 1, wherein the air-guiding channel has a tube portion on an inlet end of the air-guiding channel that opens into the sorption compartment such that an inflow direction of the air-guiding channel is diverted into a through-flow direction of the sorption compartment.

24. The dishwasher of claim 23, wherein the inflow direction is diverted into the through-flow direction by between 45° and 135°.

25. The dishwasher of claim 24, wherein the inflow direction is diverted into the through-flow direction by approximately 90°.

26. The dishwasher of claim 1, wherein an outflow direction of the air flow exiting the sorption compartment corresponds substantially to the through-flow direction of the sorption compartment.

27. The dishwasher of claim 1, further comprising a base module; wherein the washing compartment has a base; and wherein the sorption compartment is accommodated in the base module underneath the base of the washing compartment.

28. The dishwasher of claim 1, wherein the air-guiding channel is arranged substantially outside the washing compartment.

29. The dishwasher of claim 1, further comprising a fan; wherein the sorption compartment has an intake opening; wherein the air-guiding channel has an inlet-end tube portion; and wherein, when viewed in the direction of the air flow, the fan is inserted upstream of the sorption compartment into the inlet-end tube portion of the air-guiding channel to generate a forced air flow in the direction of the intake opening of the sorption compartment.

30. The dishwasher of claim 29, further comprising a base module underneath the washing compartment, wherein the fan is arranged in a base module underneath the washing compartment.

31. The dishwasher of claim 1, wherein the sorption compartment has an intake opening; wherein the air-guiding channel has an inlet connecting piece; and wherein a first through-flow cross-sectional area for the sorption drying material in the interior of the sorption compartment is greater than a second through-flow cross-sectional area of the inlet connecting piece with which the air-guiding channel opens into the intake opening of the sorption compartment.

32. The dishwasher of claim 31, wherein the first through-flow cross-sectional area of the sorption compartment is between 2 times and 40 times greater than the second through-flow cross-sectional area of the inlet connecting piece of the air-guiding channel.

33. The dishwasher of claim 32, wherein the first through-flow cross-sectional area of the sorption compartment between 4 times and 30 times greater than the second through-flow cross-sectional area of the inlet connecting piece of the air-guiding channel.

34. The dishwasher of claim 33, wherein the first through-flow cross-sectional area of the sorption compartment between 5 times and 25 times greater than the second through-flow cross-sectional area of the inlet connecting piece of the air-guiding channel.

35. The dishwasher of claim 1, further comprising an outflow component; wherein the washing compartment has a base with a through opening; and wherein the sorption compartment has an upper cover part with an outflow opening that is connected, via the through opening in the base of the washing compartment, to the interior of the washing compartment by means of the outflow component.

36. The dishwasher of claim 35, wherein the outflow opening has a through-flow cross-sectional area less than a discharge cross-sectional area of the sorption unit of the sorption compartment.

37. The dishwasher of claim 36, wherein the through-flow cross-sectional area of the outflow opening is between 2 times and 40 times less than the discharge cross-sectional area of the sorption unit of the sorption compartment.

38. The dishwasher of claim 36, wherein the through-flow cross-sectional area of the outflow opening is between 4 times and 30 times less than the discharge cross-sectional area of the sorption unit of the sorption compartment.

39. The dishwasher of claim 36, wherein the through-flow cross-sectional area of the outflow opening is between 5 times and 25 times less than the discharge cross-sectional area of the sorption unit of the sorption compartment.

40. The dishwasher of claim 1, wherein the sorption unit has an intake cross-sectional area; and wherein a fill height of the sorption drying material, when viewed across the intake cross-sectional area of the sorption unit of the sorption compartment, is substantially constant.

41. The dishwasher of claim 1, wherein the sorption drying material contains at least one of:

aluminum;
silicon oxide;
silica gel; and
zeolite.

42. The dishwasher of claim 41, wherein the zeolite is at least one of type A, type X, and type Y.

43. The dishwasher of claim 1, wherein the sorption drying material in the sorption compartment is provided as a fill in the form of one of a granular solid and a granulate having a plurality of particles with a grain size of substantially between 1 and 6 mm; and wherein a fill height of the plurality of particles is at least 5 times the grain size of the plurality of particles.

44. The dishwasher of claim 43, wherein the grain size is between 2.4 mm and 4.8 mm.

45. The dishwasher of claim 43, wherein the fill height in the direction of gravity is substantially between 5 times and 40 times the grain size.

46. The dishwasher of claim 45, wherein the fill height in the direction of gravity is substantially between 10 times and 15 times the grain size.

47. The dishwasher of claim 43, wherein the fill height is substantially between 1.5 cm and 25 cm.

48. The dishwasher of claim 47, wherein the fill height is substantially between 2 cm and 8 cm.

49. The dishwasher of claim 48, wherein the fill height is substantially between 4 cm and 6 cm.

50. The dishwasher of claim 43, wherein the one of the granular solid and the granulate has a plurality of substantially spherical particles.

51. The dishwasher of claim 1, wherein the sorption drying material is one of a granular solid and a granulate with an average fill density of at least 500 $kg/m^3$.

52. The dishwasher of claim 51, wherein the average fill density is between 500 and 800 $kg/m^3$.

53. The dishwasher of claim 52, wherein the average fill density is between 600 $kg/m^3$ and 700 $kg/m^3$.

54. The dishwasher of claim 53, wherein the average fill density is between 630 $kg/m^3$ and 650 $kg/m^3$.

55. The dishwasher of claim 54, wherein the average fill density is approximately 640 $kg/m^3$.

56. The dishwasher of claim 1, further comprising at least one flow-conditioning element in at least one of the sorption compartment and an end of a tube portion of the air-guiding channel that is connected to the sorption compartment such that an equalization of a local flow cross-sectional profile of the air flow is effected as the air flow flows through the sorption compartment in the through-flow direction of the sorption compartment.

57. The dishwasher of claim 1, wherein the sorption compartment is made of a heat-resistant material.

58. The dishwasher of claim 57, wherein the heat-resistant material is metal sheet.

59. The dishwasher of claim 58, wherein the heat-resistant material is one of stainless steel and a stainless steel alloy.

60. The dishwasher of claim 1, wherein the sorption compartment at least one of:

is embodied at least in a deposition region of the sorption drying material in at least a double-walled manner; and
has a heat-resistant insulating element on at least one of the outside and the inside of the sorption compartment.

61. The dishwasher of claim 1, wherein the surface is angled at about 45 degrees with respect to the air inflow direction.

* * * * *